US006315582B1

(12) United States Patent
Nishio et al.

(10) Patent No.: US 6,315,582 B1
(45) Date of Patent: Nov. 13, 2001

(54) ELECTRONIC DEVICE FOR CONNECTING UNIVERSAL SERIAL BUSS INTERFACE EQUIPMENT

(75) Inventors: Atsushi Nishio; Katsuhiro Hori; Satoru Karahashi; Yoshiyuki Kikuchi, all of Mito (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/617,726

(22) Filed: Jul. 17, 2000

(30) Foreign Application Priority Data

Jul. 27, 1999 (JP) ..... 11-212094

(51) Int. Cl.[7] ..... H01R 13/66; H01R 13/44
(52) U.S. Cl. ..... 439/131; 439/172
(58) Field of Search ..... 439/131, 13, 172, 439/171, 173

(56) References Cited

U.S. PATENT DOCUMENTS 5,308,260 * 5/1994 Johnston et al. ..... 439/344
5,967,807 * 10/1999 Wu ..... 439/131
6,089,922 * 7/2000 Glad et al. ..... 439/131
6,191,553 * 2/2001 Feng-Jung ..... 439/131

* cited by examiner

*Primary Examiner*—Gary Paumen
*Assistant Examiner*—Felix O. Figueroa
(74) *Attorney, Agent, or Firm*—Ladas & Parry

(57) ABSTRACT

An electronic device having a contact point unit that protrudes from the casing but is protected without the use of a cap is provided. This electronic device includes a contact point unit having at least one contact point protruding from the surface of the casing of the device. This contact point unit includes a main body rotatable supported by a rotational axis extending from both side surfaces of the casing, and at least one contact point attached to the surface of the main body. The main body is rotatively moved so that the contact point moves from a contact point exposing position to a contact point accommodating position. When the contact point unit is not used, the main body of the contact point unit is rotatively moved so that the contact point is accommodated in the casing.

4 Claims, 24 Drawing Sheets

ELECTRONIC DEVICE FOR CONNECTING UNIVERSAL SERIAL BUSS INTERFACE EQUIPMENT

BACKGROUND OF THE INVENTION

1. Field of the Invention

The present invention relates generally to electronic devices such as Universal Serial Buss (USB) type devices for connecting various USB interface equipments, and, more particularly, to a structure of a contact point unit exposed through the surface of the casing of a USB-type connecting device.

2. Description of the Related Art

In recent years, USB-type interfaces (hereinafter referred to as "USB interfaces") have been employed as common interfaces for connecting various peripheral equipments, such as keyboard, mouse, and printer, to a personal computer.

In order to connect a plurality of USB interface peripheral equipments to a personal computer, a USB hub provided with a plurality of USB interface connectors is used.

In a USB interface, a cable made up of two signal lines and two power lines is used, so that power can be supplied to the peripheral equipments from each USB port via the USB hub.

FIG. 1 is a schematic view of the structure of a USB hub 1.

The USB hub 1 comprises a casing 2, a first USB port 3 formed by a USB connector disposed on the casing 2, second USB ports 4 formed by a plurality (four in FIG. 1) of USB connectors disposed on the casing 2, and a USB hub circuit 5 installed in the casing 2. The first USB port 3 is connected to the host of the USB hub circuit 5, and each of the second USB ports 4 is connected to the lower layer side of the USB hub circuit 5.

As shown in FIG.2, a personal computer 100 is connected to the first USB port 3, while a keyboard 6, a mouse 7, a printer 8, and a scanner 9, each of which is suitable for USB connection, are connected to the second USB ports 4.

With this structure, the keyboard 6, the mouse 7, the printer 8, and the scanner 9 can be used through the personal computer via the USB hub 1.

Furthermore, the USB hub 1 has a layer structure. Also, such a layer-structured USB hub can be connected by a hot-line connection (i.e., hot plugs). Thus, the usefulness of a personal computer can be increased further.

However, the USB hub 1 has disadvantages in that peripheral equipments are connected to the USB hub 1 via cables, and that the USB hub 1 is connected to a personal computer via a cable. Accordingly, a plurality of cables are required for the USB hub 1, and a large enough space for accommodating the cables is needed. Also, the arrangement of the cables becomes complicated.

To eliminate the above disadvantages, the USB hub 1 can be provided with a contact point unit exposed through the surface of the casing 2, so that the USB hub 1 can be connected to peripheral equipments without cables.

However, such an exposed contact point unit can be easily deformed by an inadvertent touch. When the contact point unit is not used, it is necessary to cover the contact point unit with a cap for protection, which only results in a higher cost.

SUMMARY OF THE INVENTION

Accordingly, it is an object of the present invention to provide an electronic device having a contact point unit that protrudes from the casing and is protected without a cap.

The object of the present invention is achieved by an electronic device comprising:

a casing; and a contact point unit that includes a main body rotatable supported by a rotational axis extending between both side surfaces of the casing, and one or more contact points attached to a surface of the main body;

wherein the main body is rotatively moved between a position where the one or more contact points are exposed and a position where the one or more contact points are accommodated in the casing, and when the contact point unit is not used, the main body of the contact point unit is rotatively moved so that the one or more contact points are accommodated in the casing.

When the contact point unit is used, the contact points are exposed through the surface of the casing. On the other hand, when the contact point unit is not used, the main body is rotatively moved around the rotational axis, so that the contact points on the surface of the main body are accommodated in the casing. Thus, the contact points are hidden and protected. With this structure, no one can inadvertently touch and deform the contact points.

In the electronic device of the present invention, the one or more contact points are collectively molded with the main body of the contact point unit, and are each bent in a U-shape. When the one or more contact points are pressed by a terminal of a mating connector, a contact portion of the one or more contact points is elastically deformed.

With this structure, each of the contact points can be elastically in contact with each corresponding terminal of a mating connector. Thus, electrical connection can be surely carried out.

In the electronic device of the present invention, the rotational axis substantially extends from the center of each side surface of the main body.

With this structure, when the main body is rotatively moved from the contact point exposing position to the contact point accommodating position, the gap between the main body and the casing is narrow enough to protect the casing from dust and dirt.

In the electronic device of the present invention, the main body of the contact point unit is provided with a rotation stopper that is brought into contact with an upper surface of the casing when the main body is rotatively moved to the position where the one or more contact points are accommodated in the casing.

With this structure, the rotation stopper is in contact with one end periphery of the casing, when the main body of the contact point unit is located at the contact point exposing position. The rotation stopper is in contact with the other end periphery of the casing, when the main body is located at the contact point accommodating position. Thus, the rotation of the main body is restricted within the range from the contact point exposing position and the contact point accommodating position.

In the electronic device of the present invention, the main body has a cylindrical shape, with the rotational axis being the center, except for a region of the one or more contact points.

With this structure, when the main body of the contact point unit is rotatively moved from the contact point exposing position to the contact point accommodating position, there is only a very narrow gap between the main body and the casing. Thus, the casing can be more effectively protected form dust and dirt.

As described above, the contact point unit of the electronic device of the present invention is rotatably supported, and is rotatively moved between the contact point exposing position and the contact point accommodating position. When the contact point unit is used, the main body is carried to the contact point exposing position, so that the contact points can be brought into contact with the contact points of a mating connector. When the contact point unit is not used, the main body is carried to the contact point accommodating position, thereby protecting the contact points.

Other objects, features and advantages of the present invention will become more apparent from the following detailed description when read in conjunction with the accompanying drawings.

DESCRIPTION OF THE PREFERRED EMBODIMENTS

The following is a description of embodiments of the present invention, with reference to the accompanying drawings.

FIG. 3 and FIGS. 4A to 4D illustrate a USB-type connecting system in which USB-type connecting devices are combined.

Figure 1:
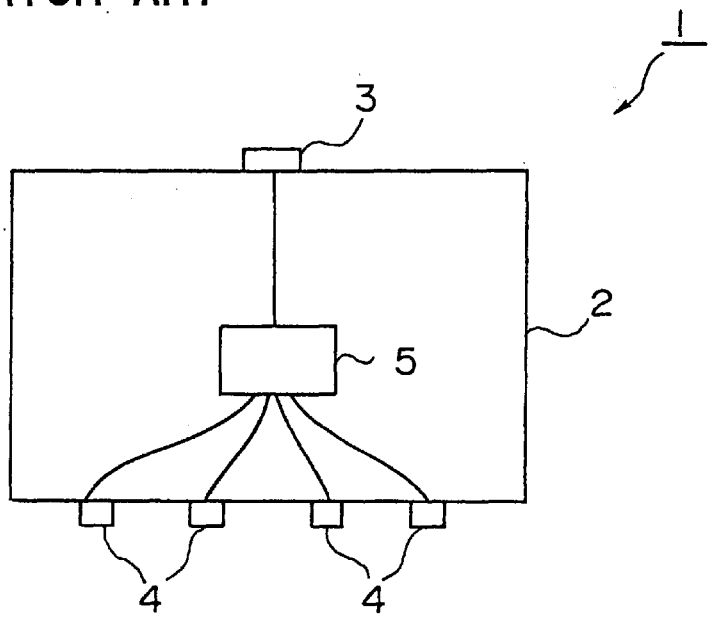
FIG. 1 PRIOR ART
FIG. 1 is a schematic view showing an example of a conventional USB hub.
Figure 2:
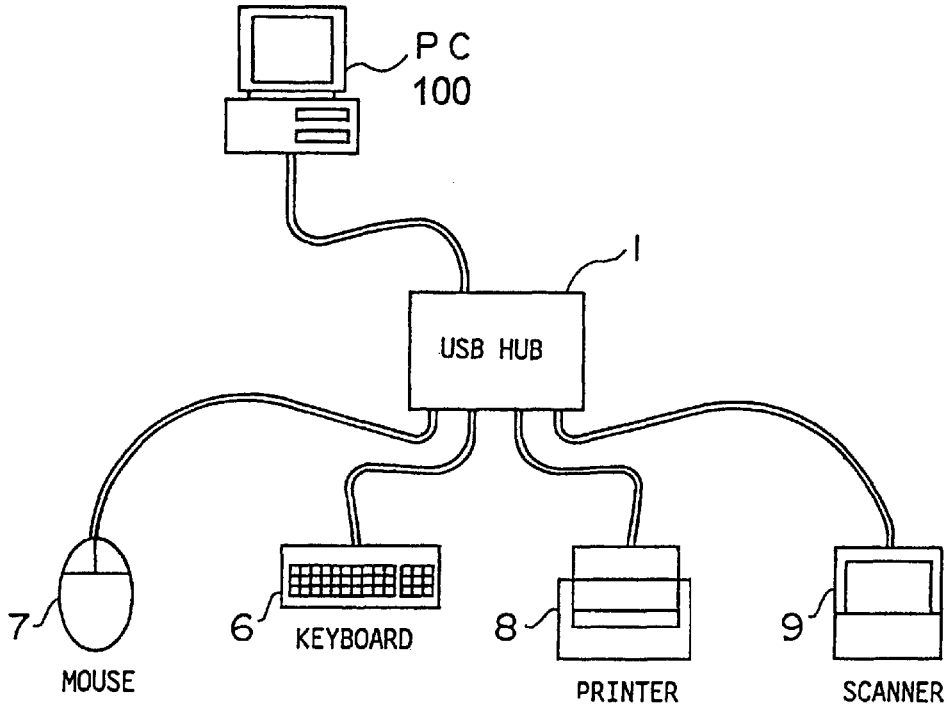
FIG. 2 PRIOR ART
FIG. 2 is a schematic view showing the USB hub of FIG. 1 in practical use.
Figure 3:
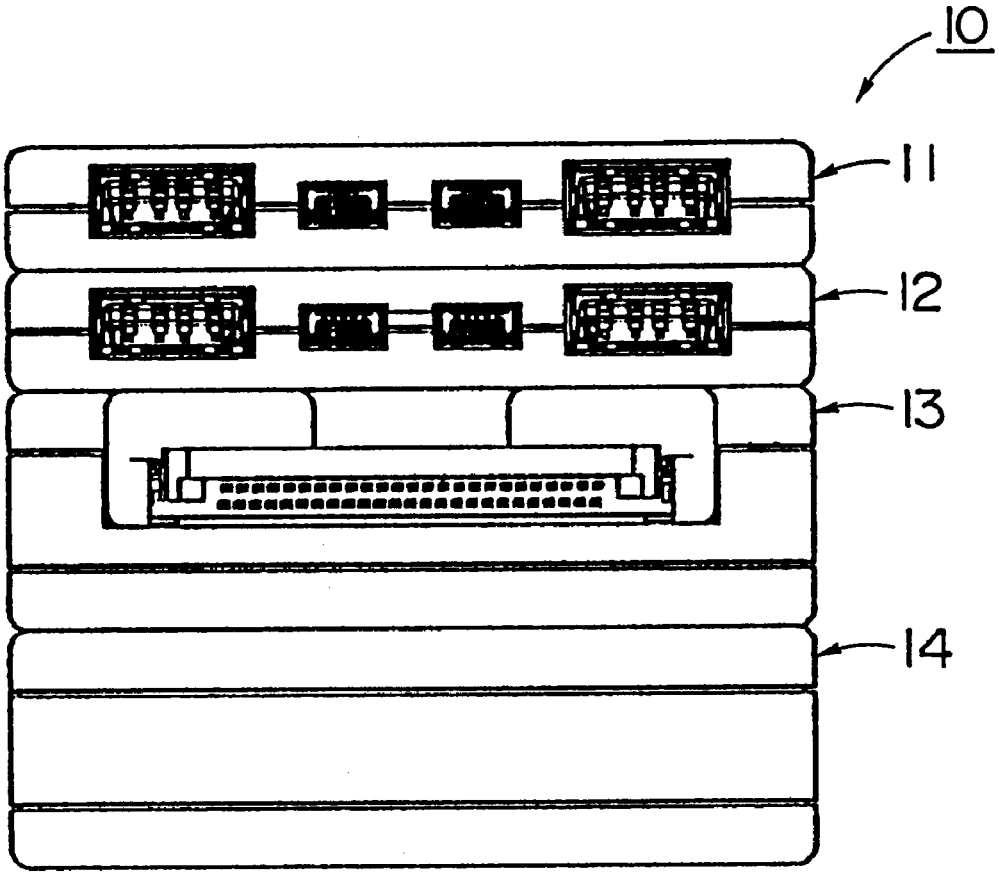
FIG. 3 is a schematic front view of a USB-type connecting system comprising USB-type connecting devices each provided with a contact point unit of the present invention.
Figure 4A:
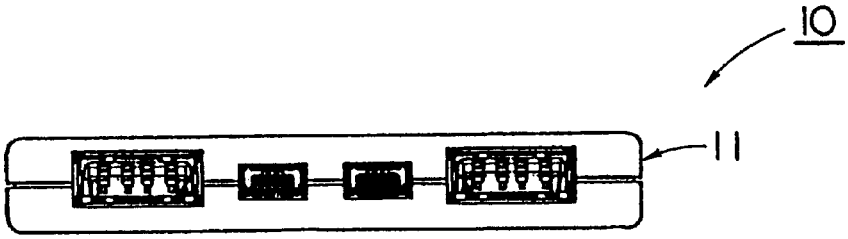
FIGS. 4A to 4D are schematic front views of the USB connecting devices in the USB-type connecting system of FIG. 3.
Figure 4B:
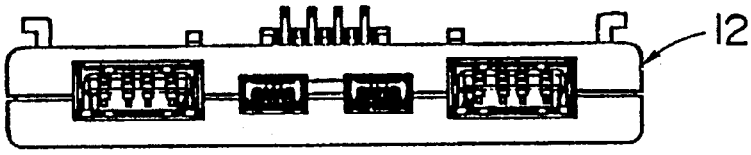
Figure 4C:
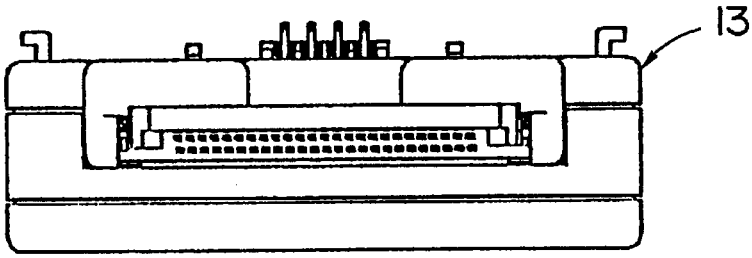
Figure 4D:
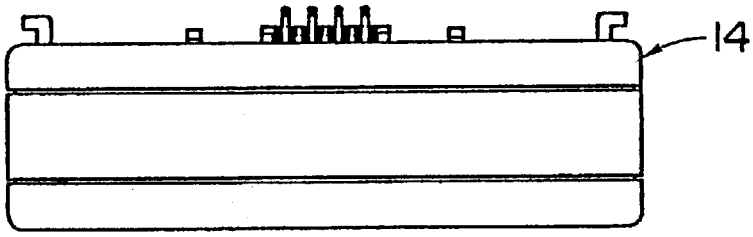

In FIG. 3, a USB-type connecting system 10 comprises USB-type connecting devices 11, 12, 13, and 14.

The USB-type connecting device 11 serves as a main USB hub, and is to be connected to a host computer via a USB cable.

The USB-type connecting device 12 is an option USB hub to be connected to the main USB hub.

The USB-type connecting device 13 is a compact flash card reader as an auxiliary memory unit.

The USB-type connecting device 14 is a power source unit which accommodates a power supply battery for USB interfaces.

The USB-type connecting devices 12, 13, and 14 each have a contact point unit 20 on the upper surface.

Figure 5A:
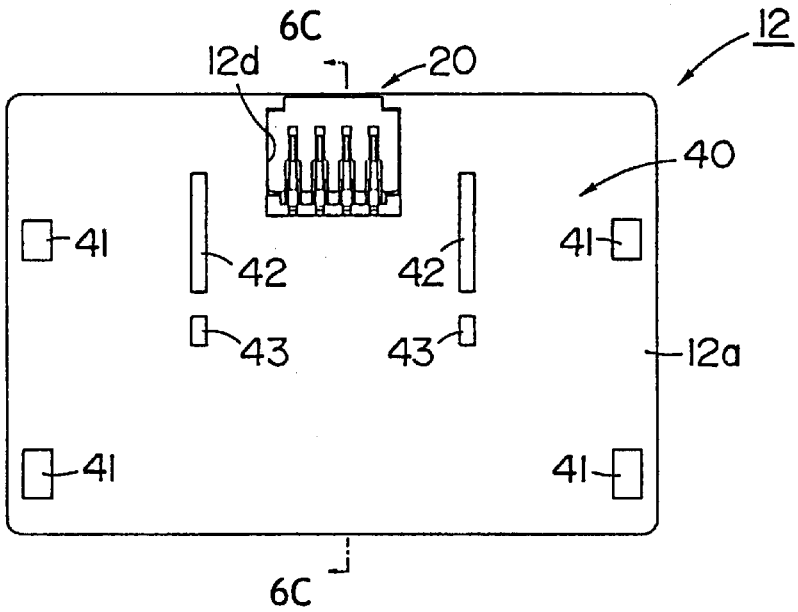
FIG. 5A is a plan view of a USB-type connecting device having a first structure included in the USB-type connecting system of FIG. 3.
Figure 5B:
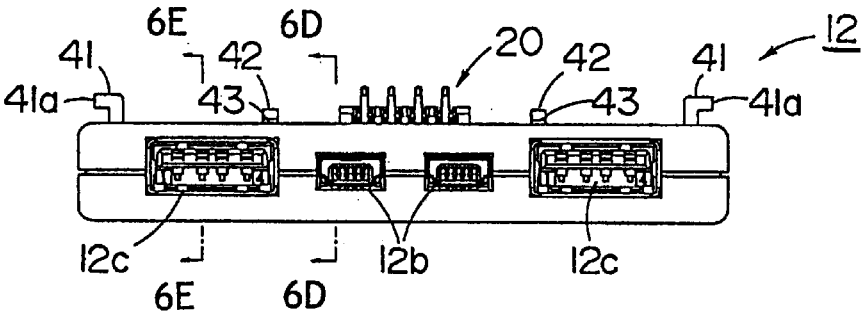
FIG. 5B is a front view of the USB-type connecting device of FIG. 5A.
Figure 5C:
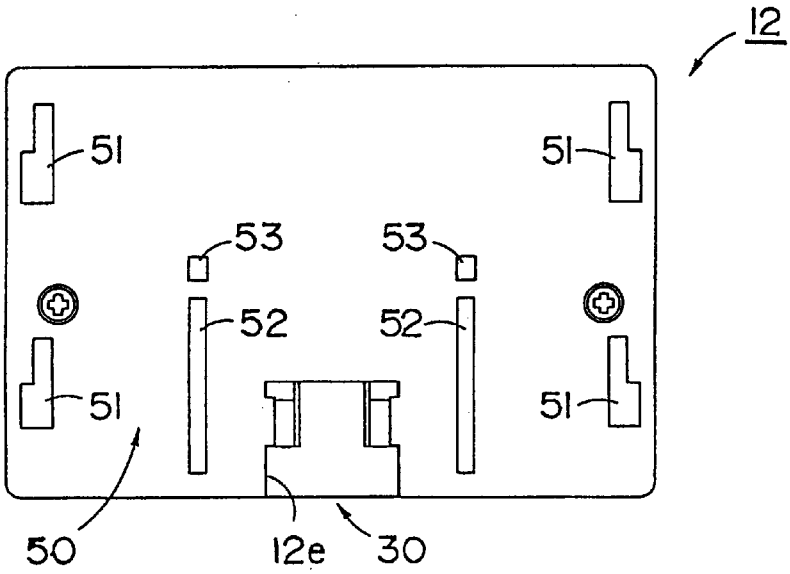
FIG. 5C is a bottom view of the USB-type connecting device of FIG. 5A.
Figure 6A:
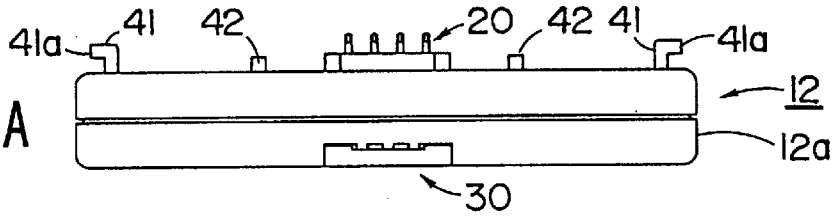
FIG. 6A is a rear view of the USB-type connecting device of FIG. 5A.
Figure 6B:
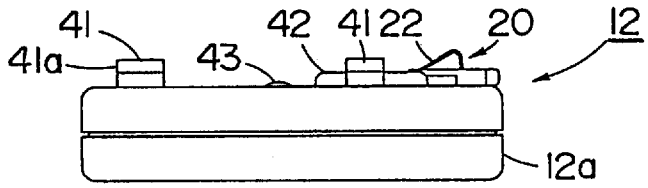
FIG. 6B is a side view of the USB-type connecting device of FIG. 5A.
Figure 6C:
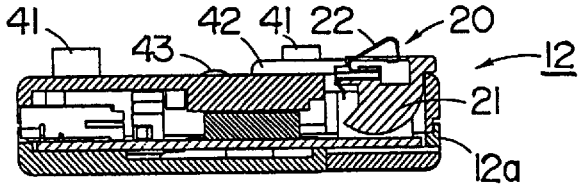
FIG. 6C is a sectional view of the USB-type connecting device of FIG. 5A.
Figure 6D:
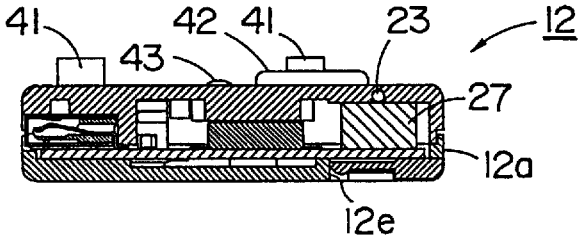
FIG. 6D is a sectional view of the USB-type connecting device of FIG. 5B.
Figure 6E:
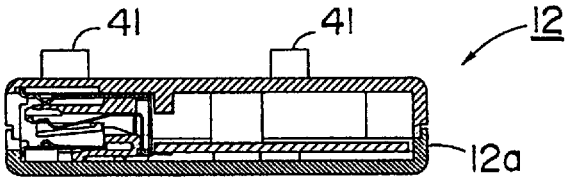
FIG. 6E is a sectional view of the USB-type connecting device of FIG. 5B.

The USB-type connecting devices 11, 12, and 13 each have a terminal unit 30 on the lower surface (see FIG. 5C).

First, the USB-type connecting device 12 provided with the contact point unit 20 and the terminal unit 30 will be described in detail.

As shown in FIGS. 5A to 5C and 6A to 6E, the USB-type connecting device 12 serves as a USB hub, and comprises a flat rectangular parallelepiped casing 12*a*, the contact point unit 20 disposed on the upper surface of the casing 12*a*, and the terminal unit 30 disposed on the lower surface of the casing 12*a*.

The contact point unit 20, as the USB port of the upper layers, is connected to a chip-like USB hub circuit-mounted on a substrate (not shown) provided in the device 12.

Two different types of USB ports 12*b* and 12*c* are disposed on the front side surface of the casing 12*a*. The USB ports 12*b* and 12*c*, and the terminal unit 30 serve as the USB port of the lower layers, and are connected to the USB hub circuit.

The USB-type connecting device 12 is also provided with joining portions 40 and 50 on the upper surface and the lower surface of the casing 12*a* for positioning and fixing with other USB connecting devices.

Figure 7A:
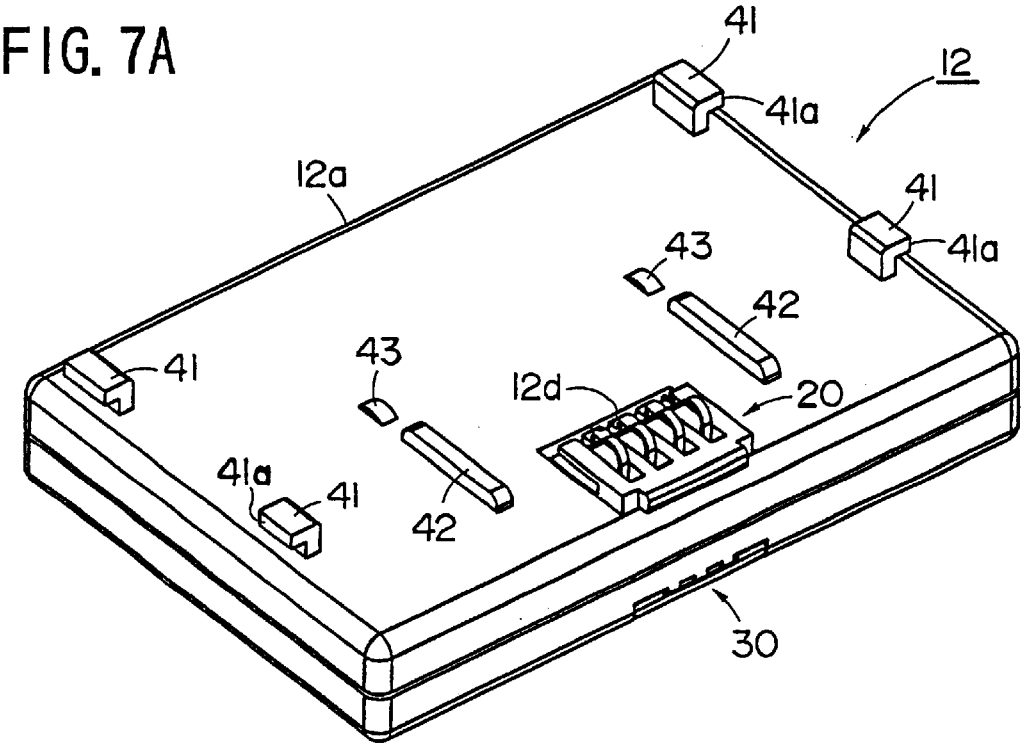
FIG. 7A is a perspective view of the USB-type connecting device of FIG. 5A.
Figure 7B:
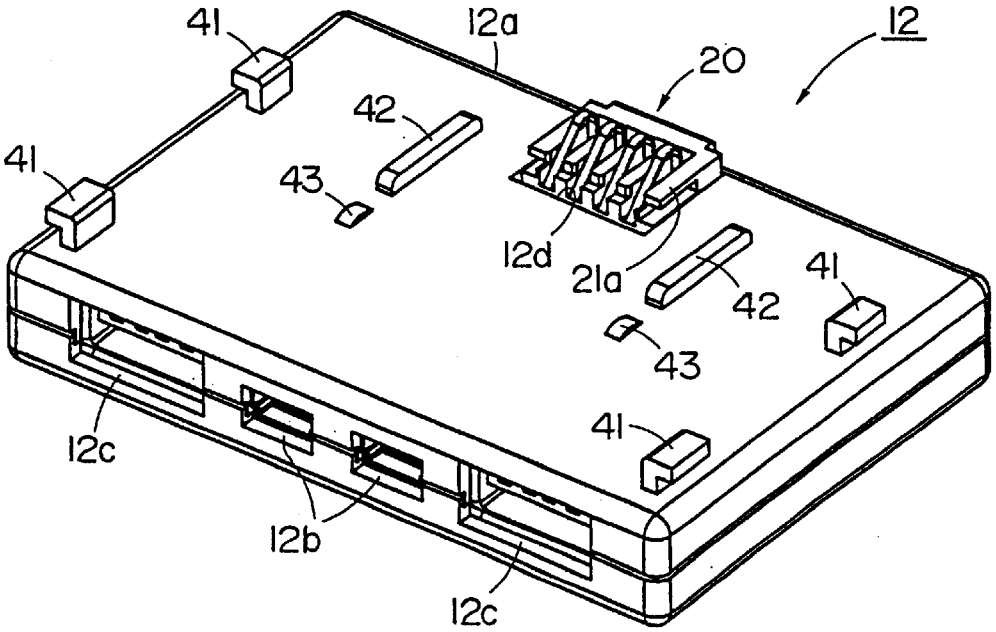
FIG. 7B is a perspective view of the USB-type connecting device of FIG. 5A.

As shown in FIGS. 5A, 7A, and 7B, the joining portion 40 is situated on the upper surface of the casing 12*a*, and comprises two pairs of hooks 41 that are engaging protrusions formed on both end regions, a pair of guide protrusions 42 formed on both sides of the contact point unit 20, and a pair of positioning protrusions 43 formed on the lines extending from the guide protrusions 42.

The hooks 41 protrude upward and have hook claws 41*a* extending outward. Thus, each of the hooks has a reverse L-shape, and is integrally molded with casing 12*a*.

The guide protrusions 42 extend in parallel with each other on the upper surface of the casing 12*a*, and are also integrally molded with the casing 12*a*.

The positioning protrusions 43 are semicircles extending backward and forward, and protruding only slightly.

Figure 8A:
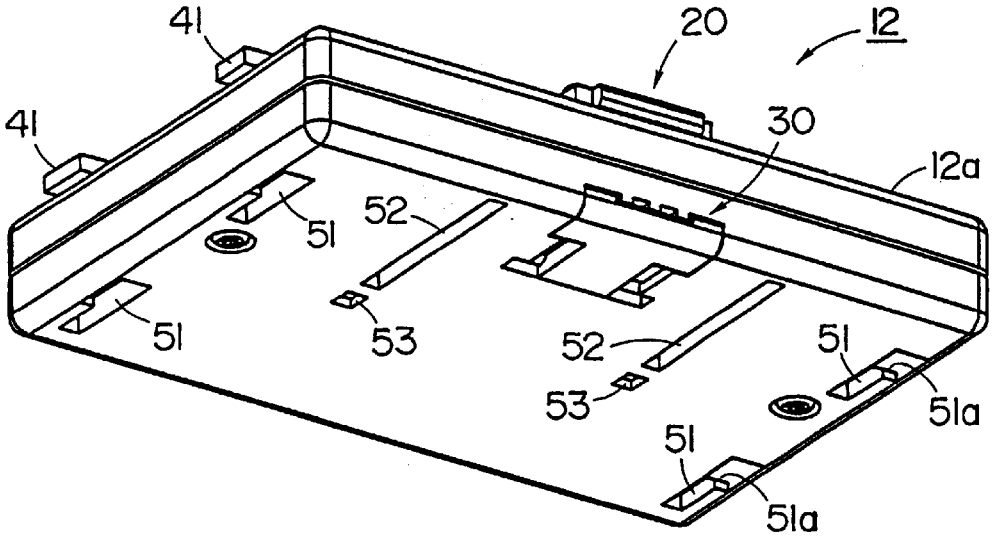
FIG. 8A is a perspective view of the USB-type connecting device of FIG. 5A.
Figure 8B:
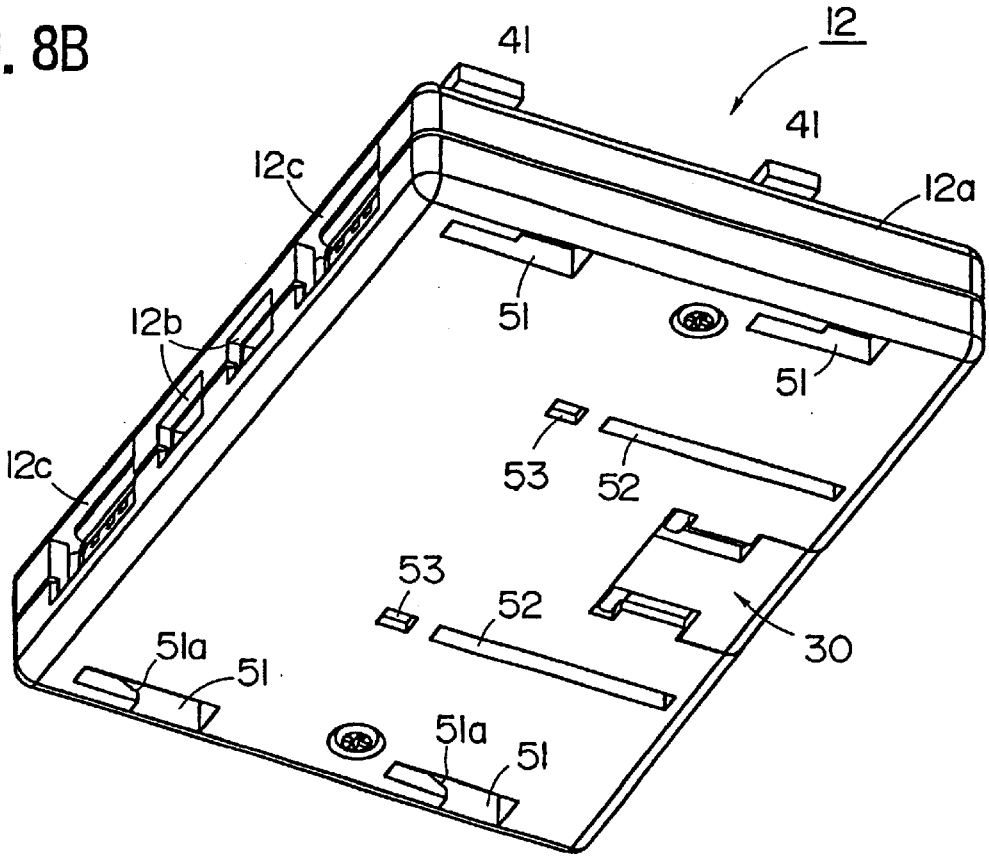
FIG. 8B is a perspective view of the USB-type connecting device of FIG. 5A.

As shown in FIGS. 5C, 8A, and 8B, the joining portion 50 is situated on the lower surface of the casing 12*a*, and comprises two pairs of hook holes 51 formed in both end regions, a pair of guide grooves 52 formed on both sides of the terminal unit 30, and a pair of positioning holes 53 formed on the lines extending from the guide grooves 52.

The hook holes 51 are located in the positions corresponding to the hooks 41, and extend backward and forward. The rear end of each of the hook holes 51 is wide enough to accommodate and release each corresponding hook claw 41*a*, while the front end is narrow enough to engage with each corresponding hook claw 41*a*.

On the inner side of the narrow portion of each of the hook holes 51, a sloped notch 51*a* is formed to facilitate the sliding of each corresponding hook claw 41*a*, as shown in FIGS. 8A and 8B.

The guide grooves 52 are located in the positions corresponding to the guide protrusions 42, and extend backward and forward in parallel with each other. These guide grooves 52 are integrally molded with the casing 12*a*.

The positioning holes 53 are located in the positions corresponding to the positioning protrusions 43.

As shown in FIGS. 6C, 7A and 7B, 9A to 9D, 11A to 11D, and 13A and 13B, the contact point unit 20 comprises a main body 21 rotatably supported with the casing 12*a*, a plurality (four, in the drawings) of contact points 22 formed in parallel with each other on the surface of the main body 21, a rotational axis 23 protruding from both side surfaces of the main body 21, and a rotation stopper protrusion 24.

The main body 21 is made of a plastic material, for instance. The contact points 22 are incorporated into the main body 21 by insert molding.

Figure 9A:
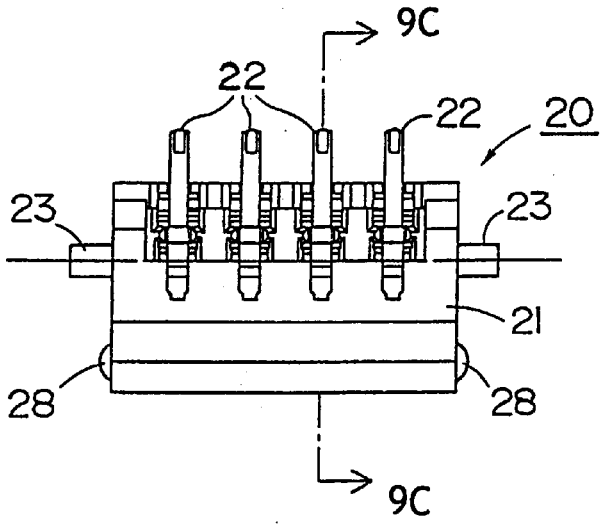
FIG. 9A is a front view of a contact point unit of the USB-type connecting device of FIG. 5A.
Figure 9B:
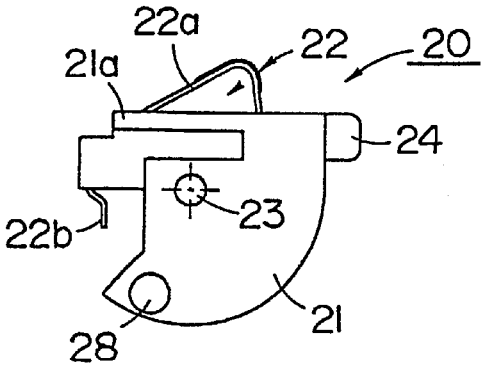
FIG. 9B is a right side view of the contact point unit of FIG. 9A.
Figure 9C:
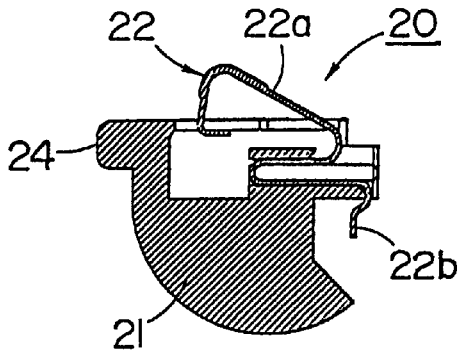
FIG. 9C is a sectional view of the contact point unit of FIG. 9A.
Figure 9D:
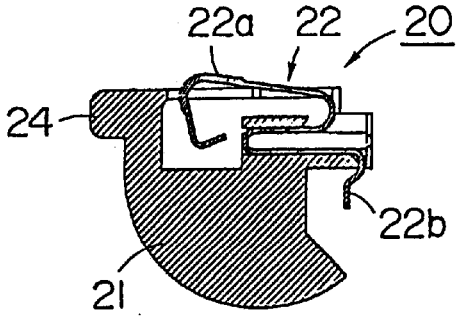
FIG. 9D is a sectional view of the contact point unit when a contact point is elastically deformed.

Each of the contact points 22 is made of a conductive elastic material, and has a U-shape. When one end 22*a* of each of the contact points 22 is brought into contact with each corresponding contact point of the terminal unit 30, the end 22*a* is elastically deformed as shown in FIG. 9D, and the other end 22*b* protrudes from the outer surface of the main body 21.

The main body 21 has a cylindrical shape except for the region of the contact points 22, and is provided with the rotational axis 23 through the center of either side surface.

Figure 10:
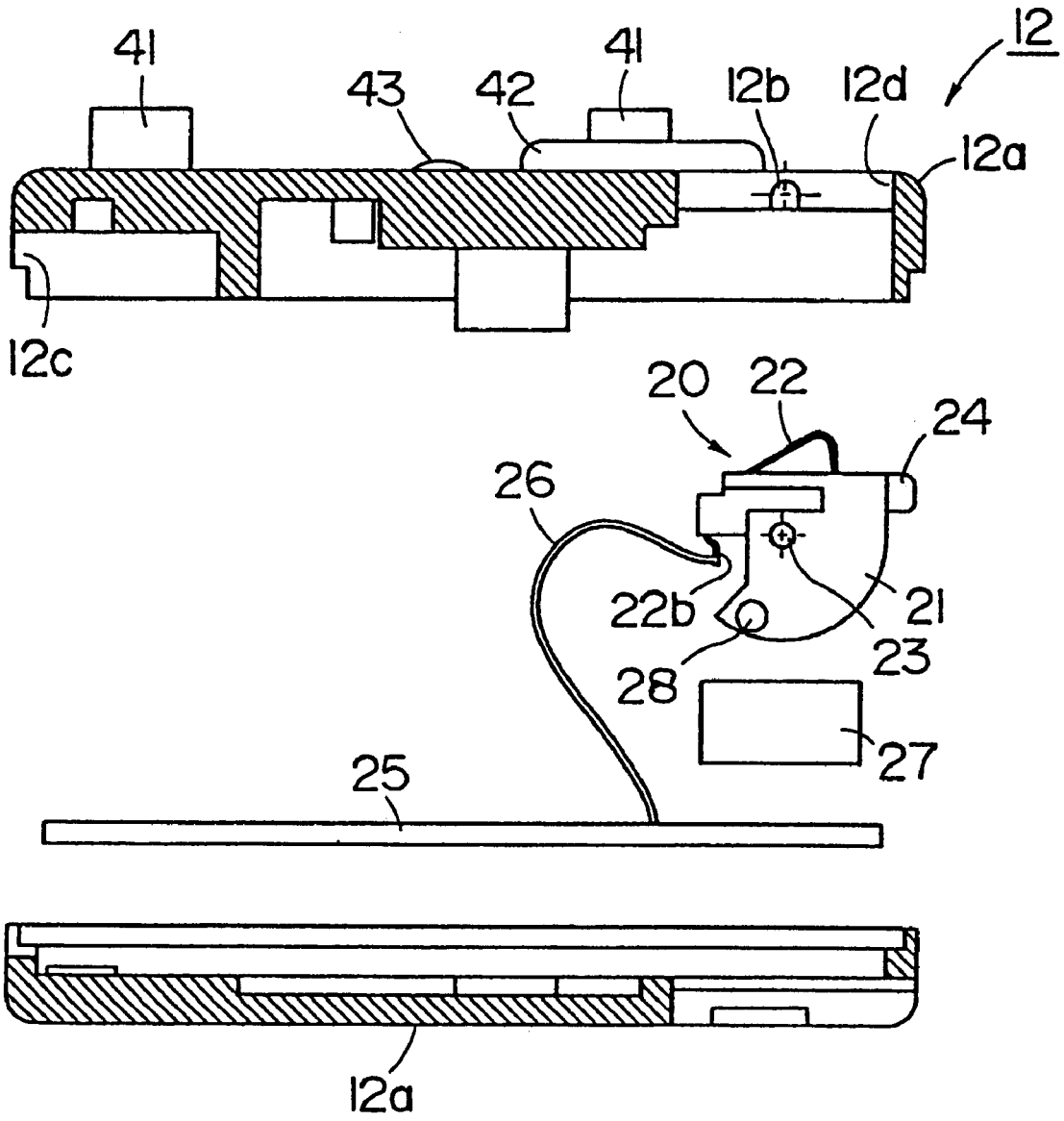
FIG. 10 illustrates the assembling process of the contact point unit of FIG. 9A.

The contact point unit 20 is assembled as shown in FIG. 10.

More specifically, the other ends 22*b* of the contact points 22 are electrically connected via a lead wire 26 to a connection pattern on a substrate 25 to be accommodated in the casing 12*a*. The rotational axis 23 is then inserted into bearings 12*b* formed in the casing 12*a*, and is held by a fixing member 27, thereby closing the casing 12. Thus, the assembling of the contact point unit 20 is completed.

Figure 11A:
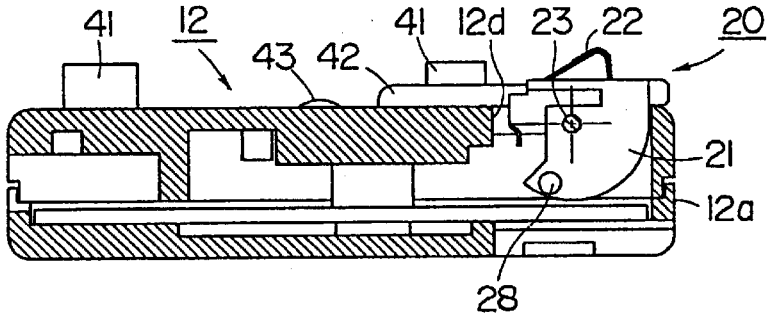
FIGS. 11A to 11D are sectional view of the contact point unit of FIG. 9A in different rotational states.
Figure 11B:
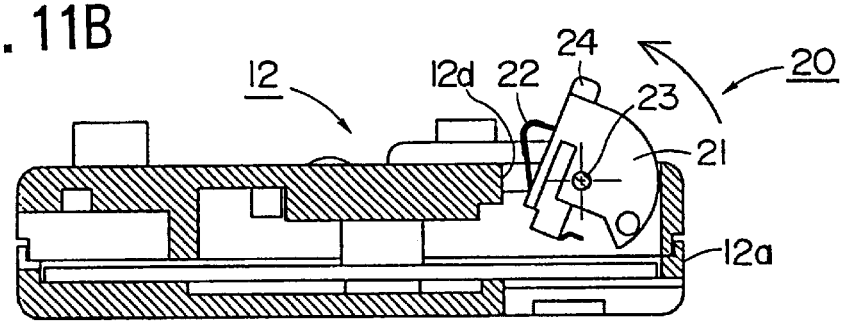
Figure 11C:
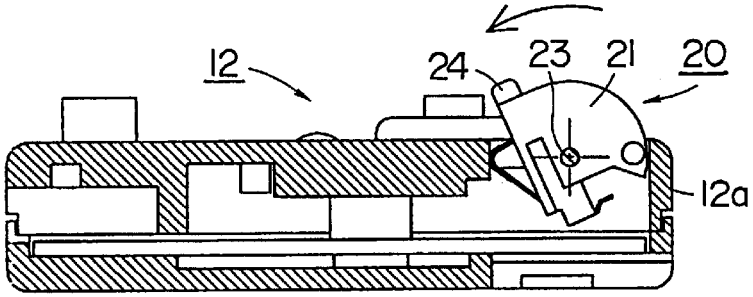
Figure 11D:
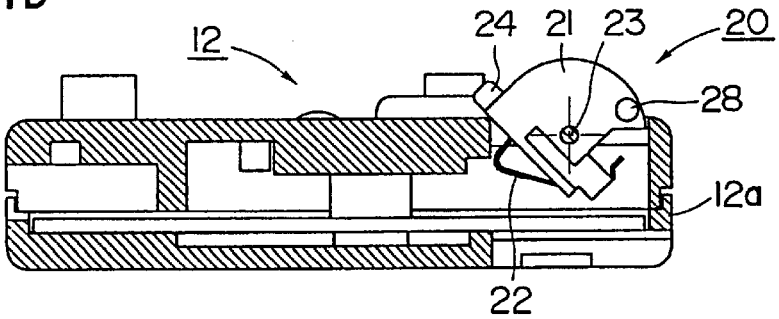
Figure 12A:
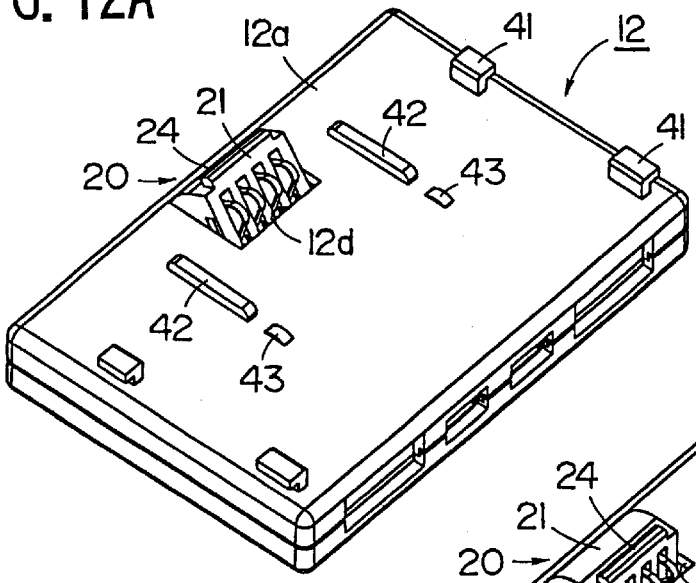
FIGS. 12A to 12C are perspective view of the contact point units of FIG. 9A in different rotational states.
Figure 12B:
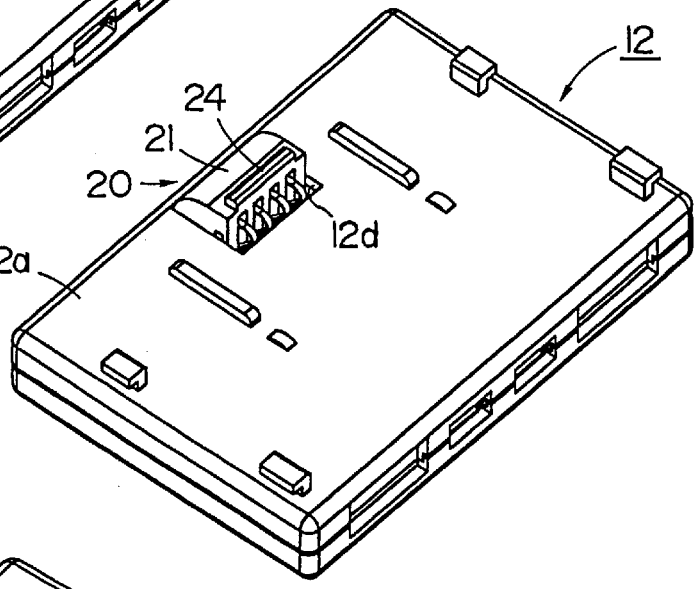
Figure 12C:
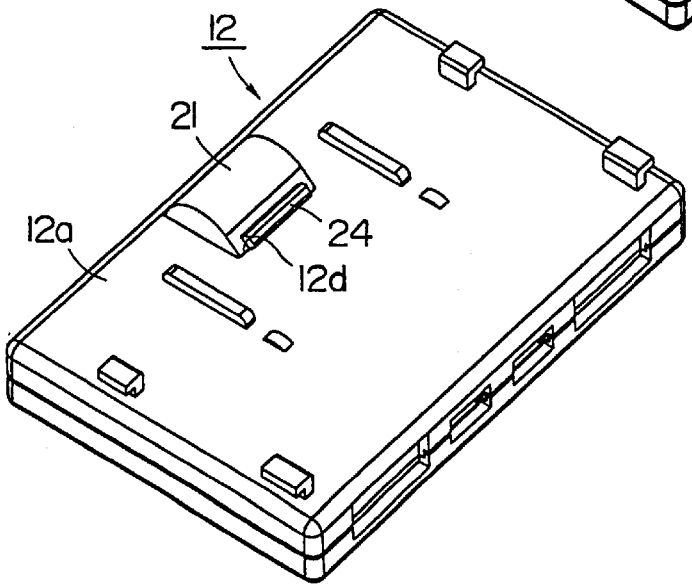
Figure 13A:
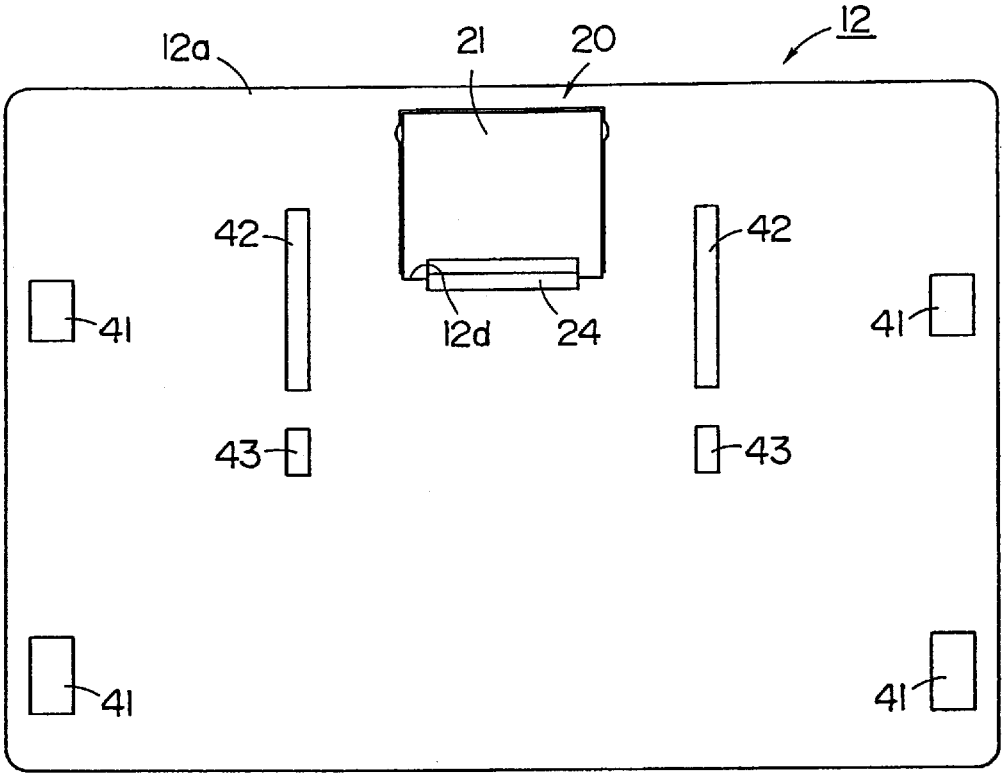
FIG. 13A is a plan view of the USB-type connecting device, with the contact points of the contact point unit being accommodated.
Figure 13B:
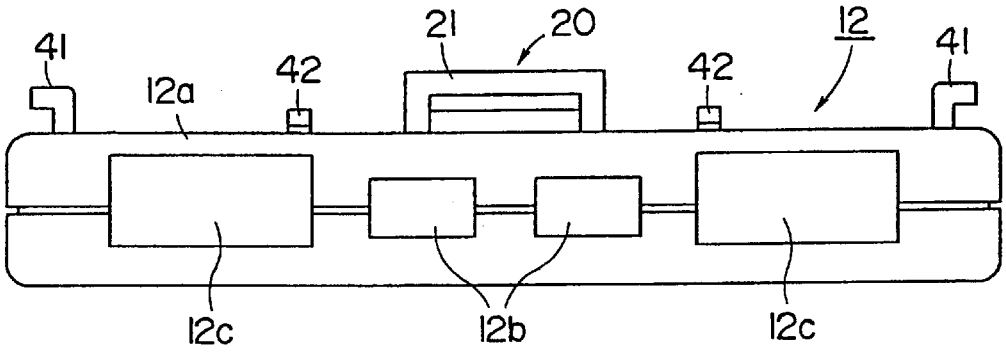
FIG. 13B is a front view of the USB-type connecting device of FIG. 13A.

In the normal state, i.e., when the contact point unit 20 is used, the contact point unit 20 is located in a position where the contacts points 22 are completely exposed through a notch 12*d* formed in the rear end portion of the upper surface of the casing 12*a*, as shown in FIGS. 7A and 7B, and FIG. 11A. The contact point unit 20 is rotated around the rotational axis 23, going through a situation shown in FIGS. 11B and 12A, and a situation shown in FIGS. 11C and 12B. Finally, the rotation stopper protrusion 24 is brought into contact with the front periphery of the notch 12*d*, so that the contact point unit 20 is maintained at the contact point accommodating position, as shown in FIGS. 11D, 12C, and 13A and 13B.

Small protrusions 28 formed on the side surfaces of the main body 21 are engaged with the rear periphery of the notch 12*d*, i.e., with the surface of the casing 12*a*, so that the contact point unit 20 is held in the contact point accommodating position.

Also, since the main body 21 is cylindrical except for the region of the contact points 22 and the rotational axis 23 substantially penetrates through the center of either circular side surface of the main body, there is only a narrow gap between the main body 21 and the casing 12*a*, so that the casing 12*a* can be effectively protected from dust and dirt.

The contact point unit 20 is further provided with ribs 21*a* on both sides of the upper surface of the main body 21.

Figure 14A:
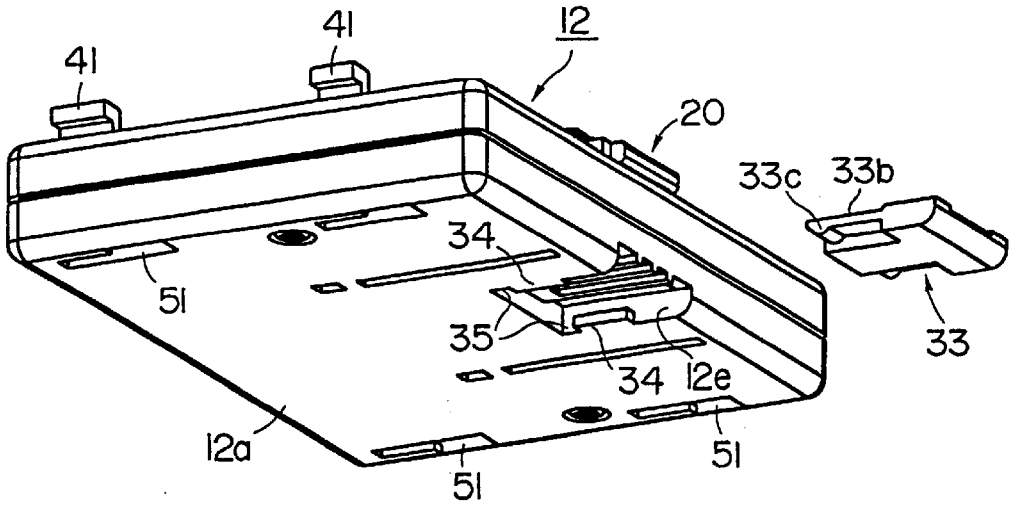
FIGS. 14A and 14B are perspective views of the USB-type connecting device of FIG. 5A, with a cover for a terminal unit being removed.
Figure 14B:
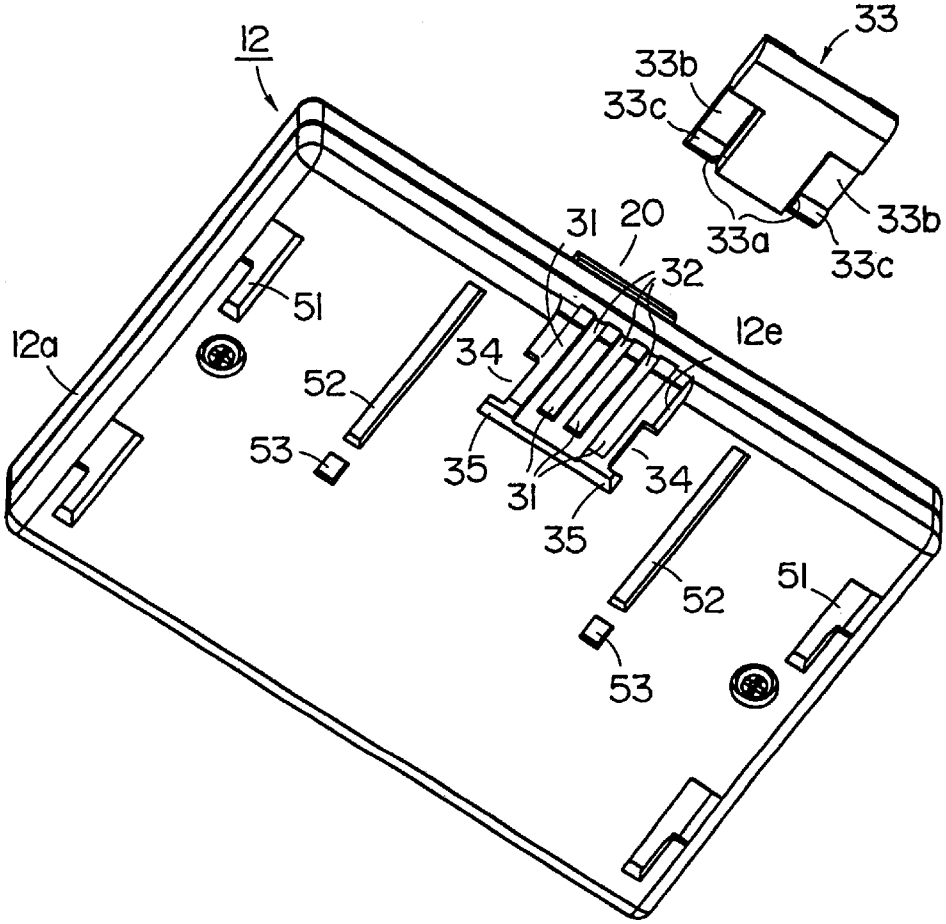
Figure 15:
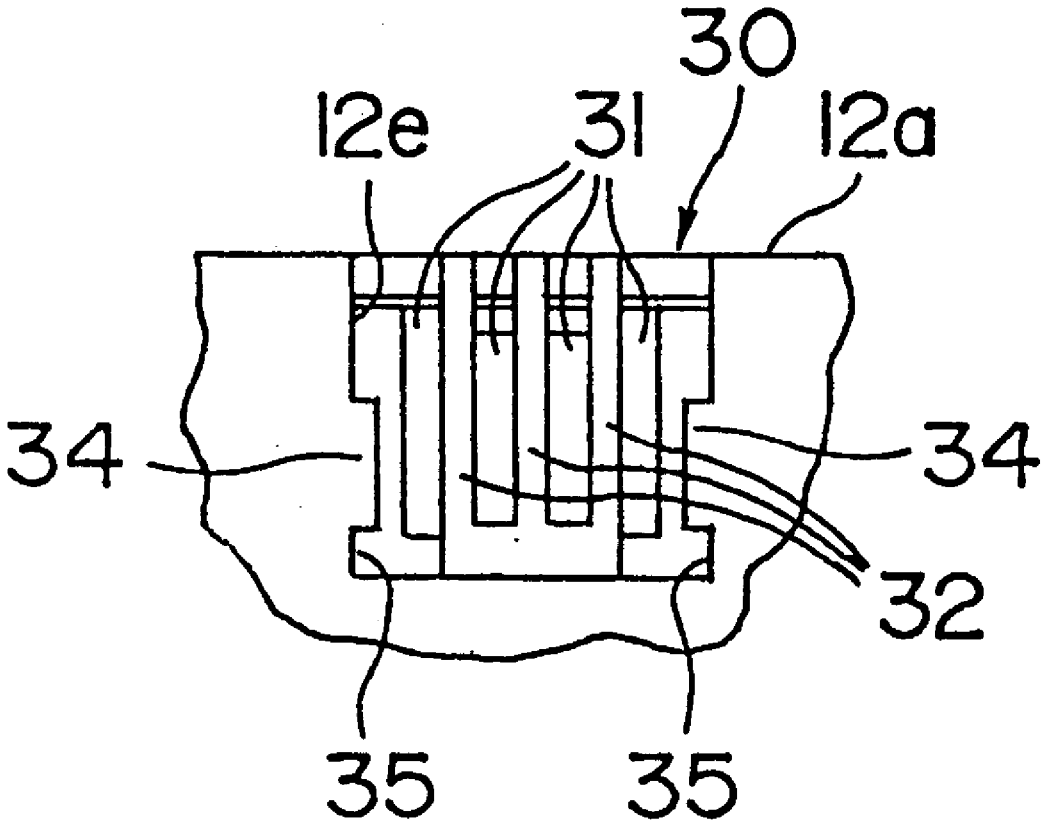
FIG. 15 is a partial bottom view of the USB-type connecting device of FIG. 5A, with the cover for the terminal unit being removed.
Figure 16A:
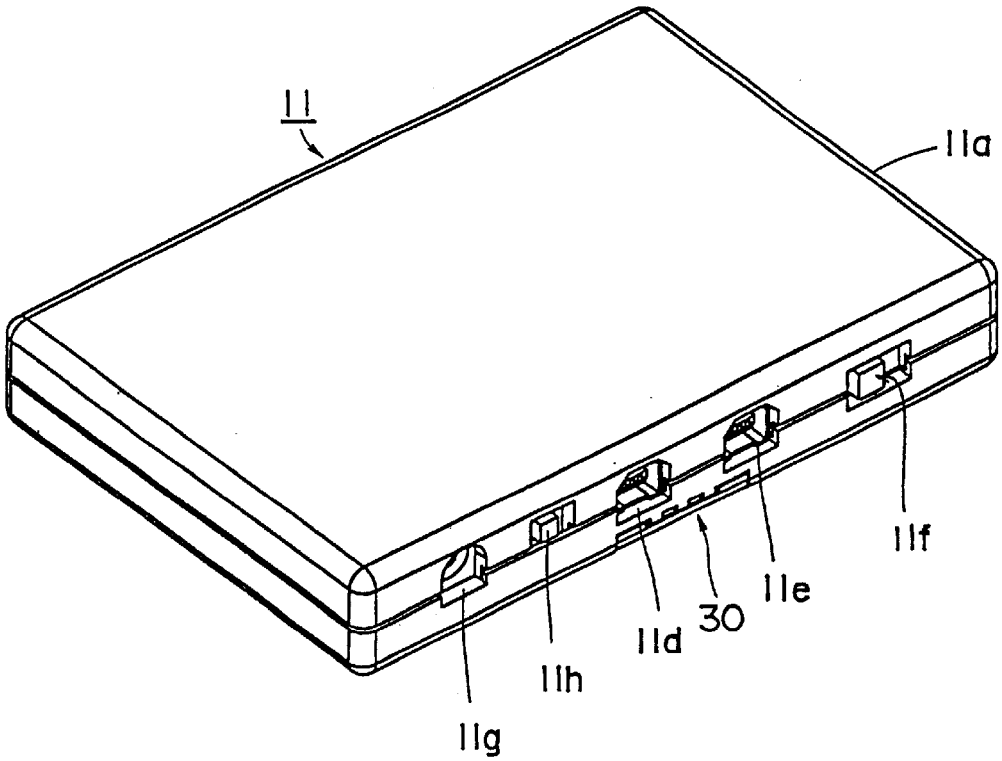
FIGS. 16A and 16B are perspective views of a USB-connecting device having a second structure in accordance with the present invention.
Figure 16B:
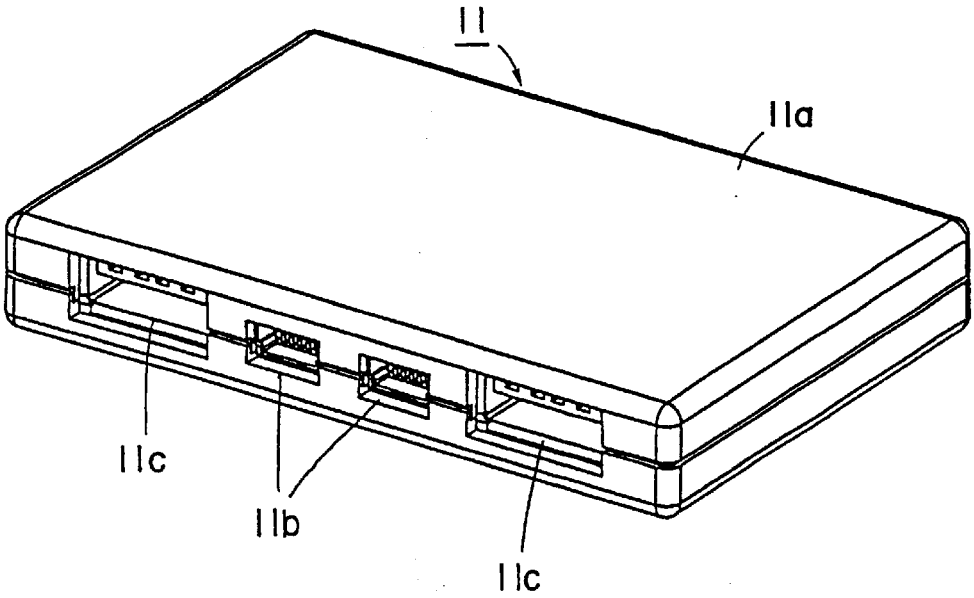
Figure 17A:
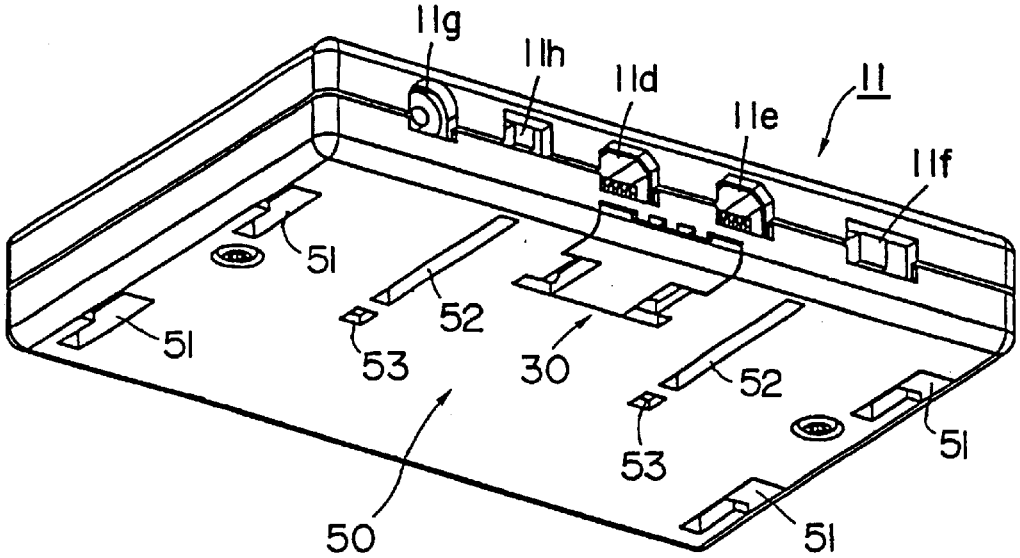
FIGS. 17A and 17B are perspective view of the USB-connecting device of FIGS. 16A and 16B.
Figure 17B:
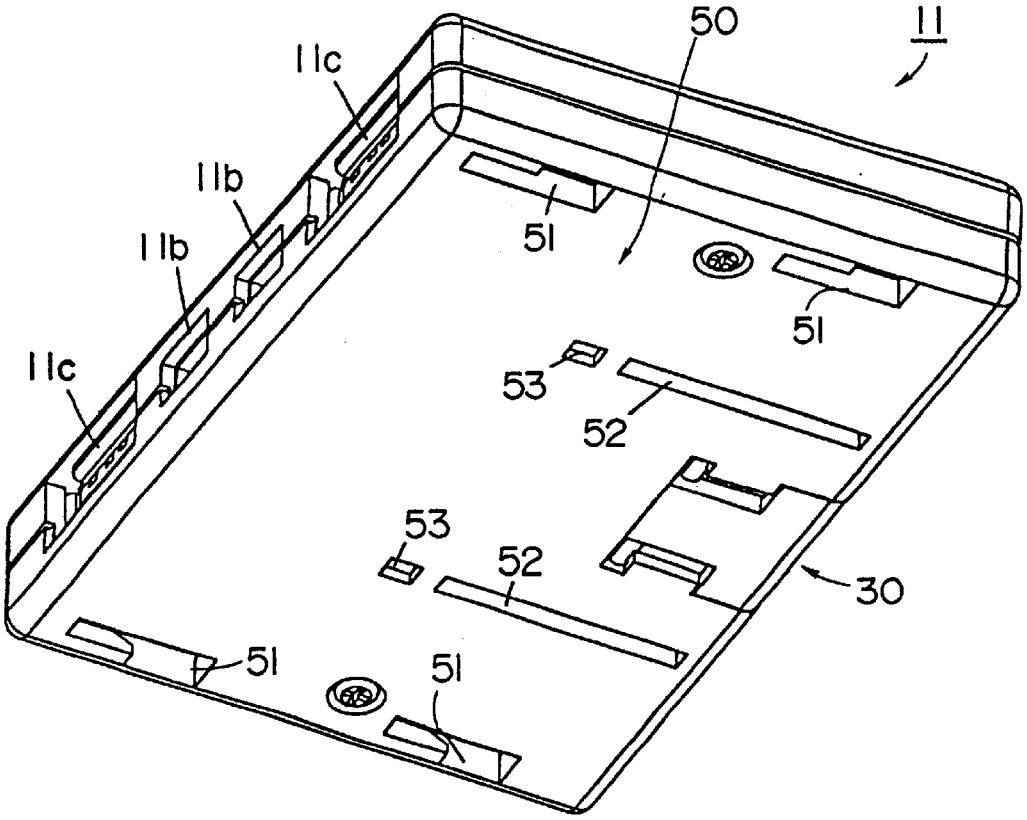
Figure 18A:
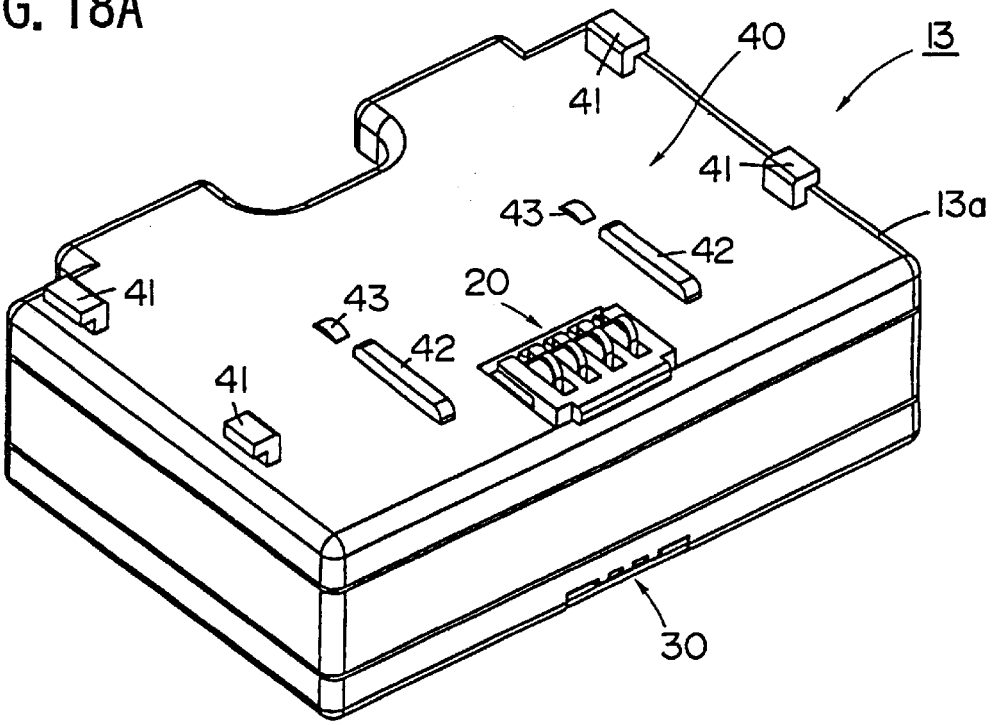
FIG. 18A and 18B are perspective views of a second example of the USB-type connecting device having the first structure.
Figure 18B:
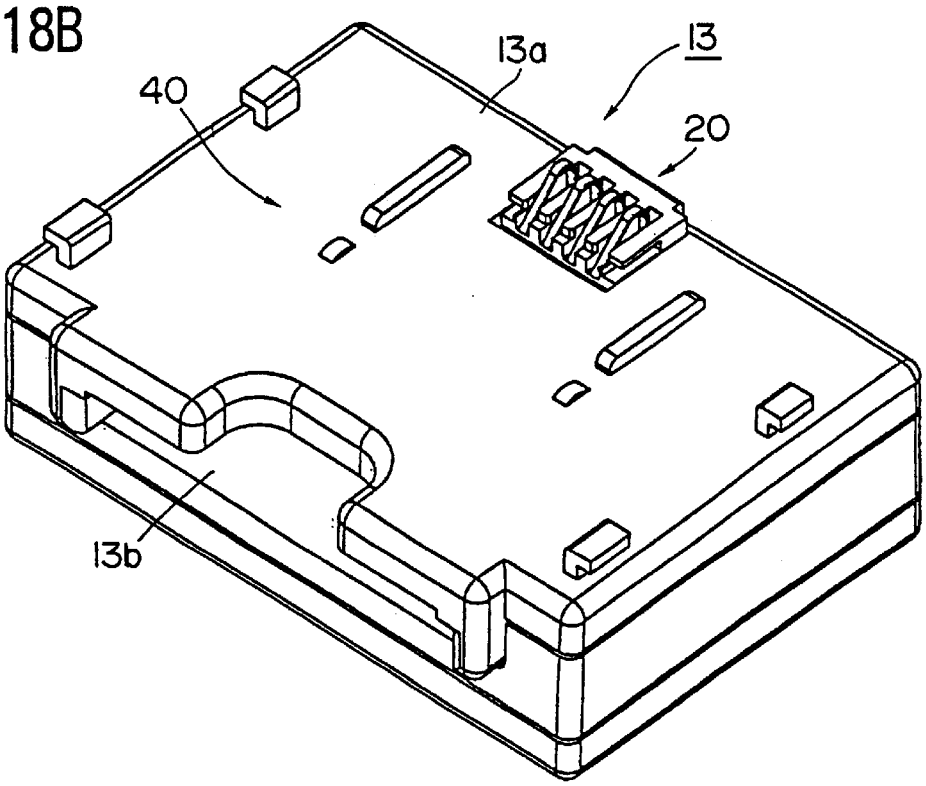
Figure 19A:
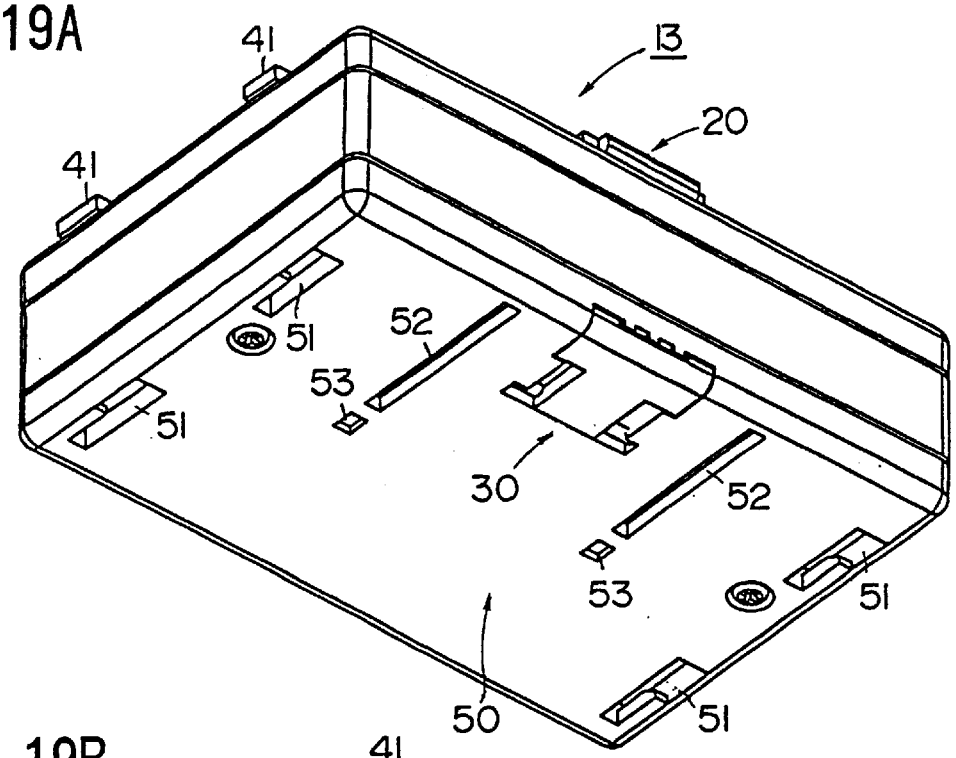
FIGS. 19A and 19B are perspective views of the USB-type connecting device of FIGS. 18A and 18B.
Figure 19B:
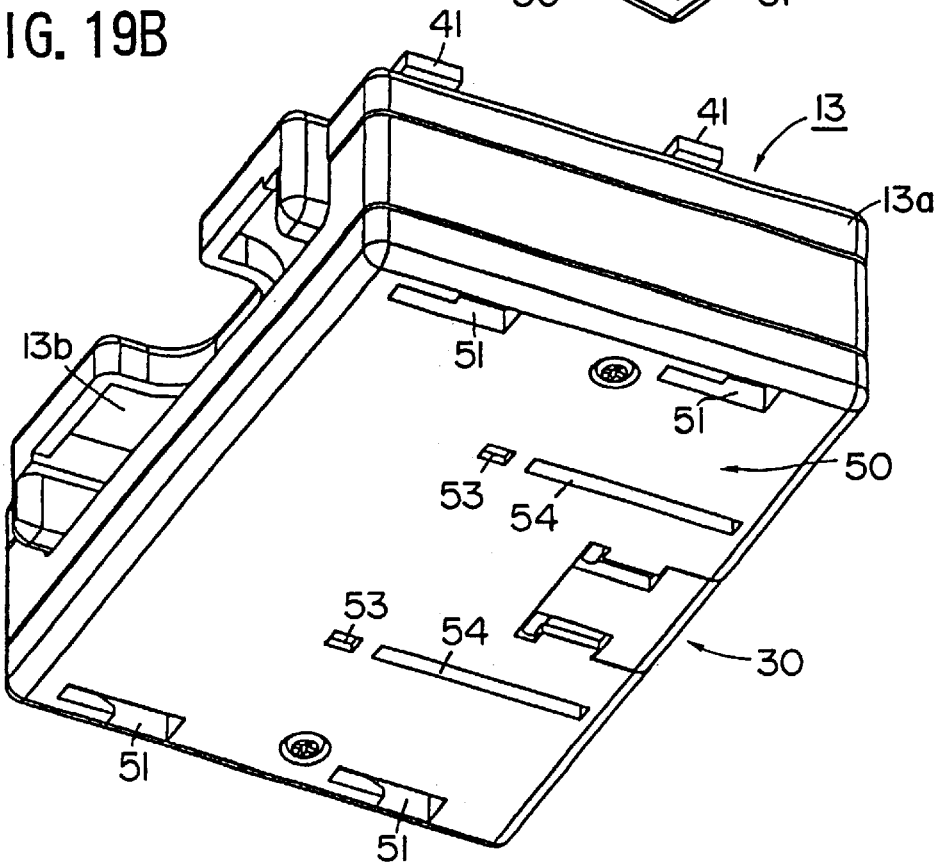

As shown in FIGS. 14A, 14B, and 15, the terminal unit 30 comprises a plurality (four, in the drawings) of terminals 31 formed by a conductive pattern on the substrate in the casing 12*a*, a frame 32 formed in a window 12*e* of the casing 12*a*, and a cover 33 detachably provided on the window 12*e*. The window 12*e* is to be blocked up by the cover 33.

Each of the terminals 31 is arranged at a distance from the lower surface of the casing 12*a*. The distance between each terminal 31 and the lower surface of the casing 12*a* is shorter than the distance between each corresponding contact point 22 and the upper surface of the casing 12*a*.

The frame 32 is situated between the terminals 31, and the lower surface of the frame 32 is located in a lower position than the surfaces of the terminals 31, thereby forming protruding ribs. In this configuration, the terminals 31 are effectively protected, and one cannot inadvertently touch the terminals 31.

The cover 33 comprises ribs 33*b* separated by slits 33*a* on either side of the front portion, and engaging portions 33*c* protruding downward.

The window 12*e* of the casing 12*a* has ribs 34 protruding inward from either side of the front portion.

The ribs 34 are engaged with the ribs 33*b* of the cover 33, thereby guiding the cover 33 in the horizontal direction. Also, when the cover 33 completely covers the window 12*e*, the engaging portions 33*c* are engaged with gaps 35 between the front end of the ribs 34 and the front end of the window 12*e*, so that the cover 33 can be held in a predetermined position.

FIGS. 16A and 16B, and 17A and 17B illustrate the USB-type connecting device 11.

The USB-type connecting device 11 serves as the main USB hub, and comprises a flat rectangular parallelepiped casing 11*a*, a terminal unit 30 disposed on the lower surface of the casing 11*a*, and a joining portion 50 also provided on the lower surface of the casing 11*a*.

A chip-type USB hub circuit is mounted on a substrate (not shown) disposed in the casing 11*a*, and two different types of USB ports 11*b* and 11*c* are disposed on the front side surface of the casing 11*a*. The USB ports 11*b* and 11*c*, and the terminal unit 30 serve as the USB port for the lower layers, and are connected to the USB hub circuit.

Two USB ports lid and lie for the upper layers are disposed on the rear side surface of the casing 11*a*. These USB ports 11*d* and 11*e* can be selectively switched by a switch 11*f*.

A power source terminal 11*g* and a power switch 11*h* are also provided on the rear side surface of the casing 11*a*. Power is supplied from the outside to the power source terminal 11*g*, and the power source is switched on and off by the power switch 11*h*.

The terminal unit 30 and the joining portion 50 have the same structures as the terminal unit 30 and the joining portion 50 of the USB-type connecting device 12.

FIGS. 18A and 18B, and 19A and 19B illustrate the USB-type connecting device 13.

The USB-type connecting device 13 is a compact flash card reader as an auxiliary memory unit, and comprises a flat rectangular parallelepiped casing 13*a*, a contact point unit 20 provided on the upper surface of the casing 13*a*, a joining portion 40, a terminal unit 30 provided on the lower surface of the casing 13*a*, and a joining portion 50 also provided on the lower surface of the casing 13*a*.

The contact point unit 20 serves as the USP port for the upper layers, and is connected to a chip-type USB hub circuit mounted on a substrate (not shown) disposed in the casing 13*a*.

An insertion slot 13*b* for accommodating a compact flash card is formed on the front side of the casing 13*a*, and a connector to be connected to a connector unit of a compact flash card and a control circuit (not shown) are mounted on the substrate deep inside the insertion slot 13*b*.

The control circuit and the terminal unit 30 serves as the USB port for the lower layers, and are also connected to the USB hub circuit.

The contact point unit 20, the terminal unit 30, and the joining portions 40 and 50 of the USB-type connecting device 13 are the same as the contact point unit 20, the terminal unit 30, and the joining portions 40 and 50 of the USB-type connecting device 12.

Figure 20A:
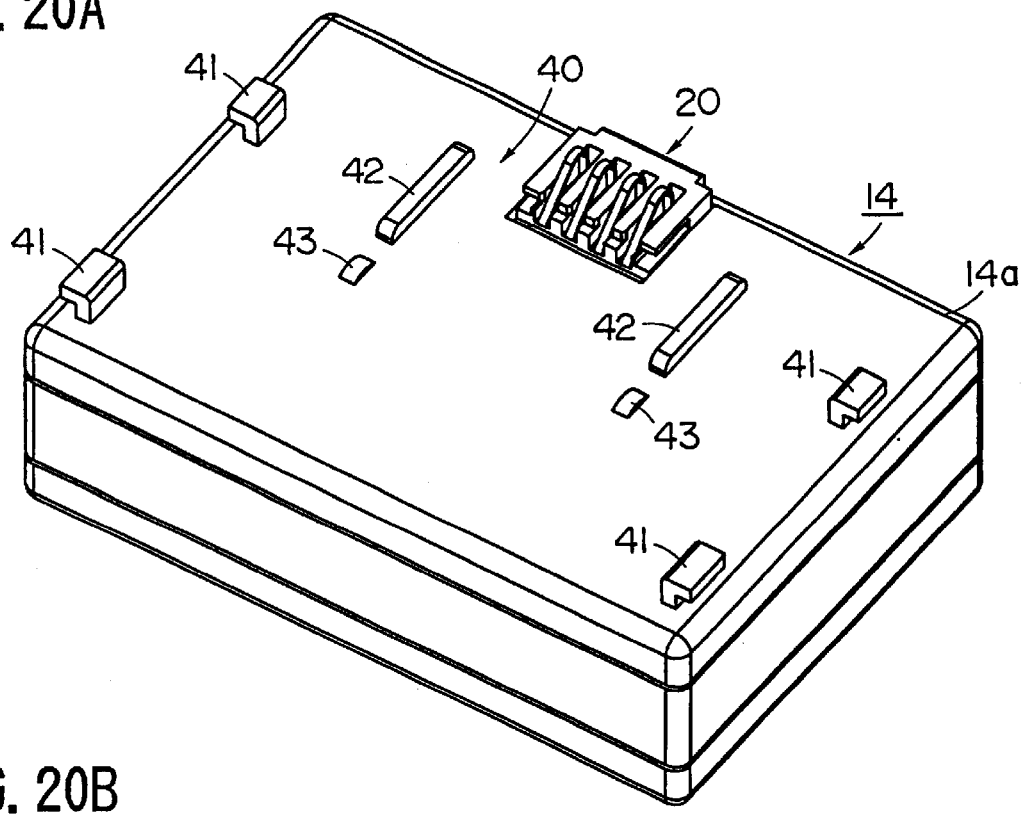
FIGS. 20A and 20B are perspective views of a third example of the USB-type connecting device having the first structure.
Figure 20B:
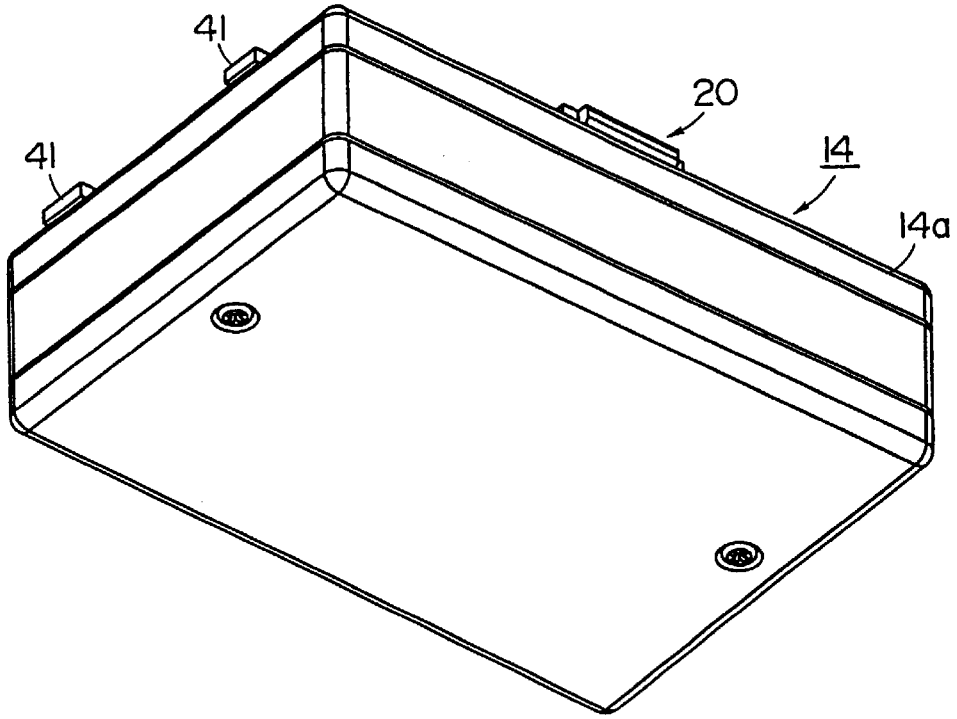
Figure 21A:
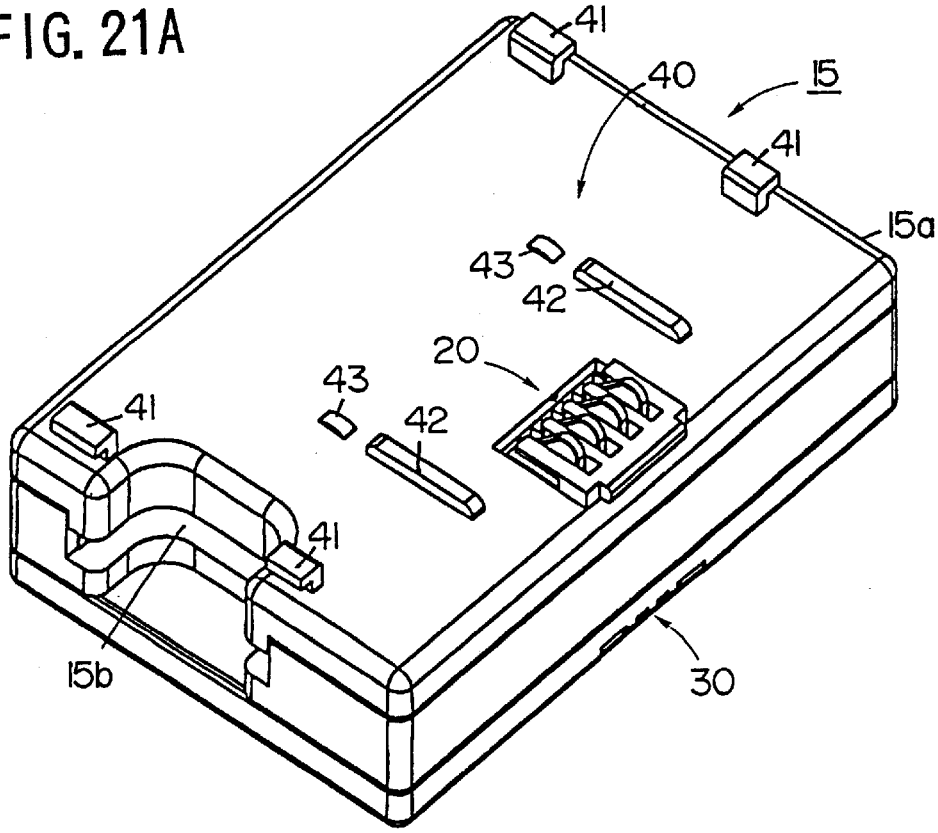
FIGS. 21A and 21B are perspective views of a second example of the USB-type connecting device having the second structure.
Figure 21B:
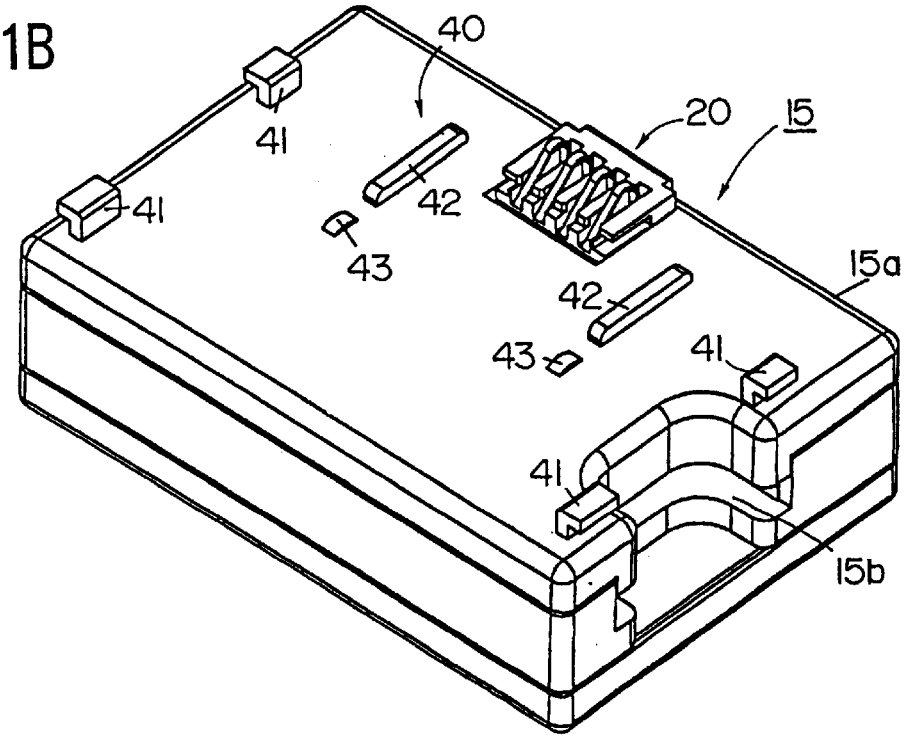
Figure 22A:
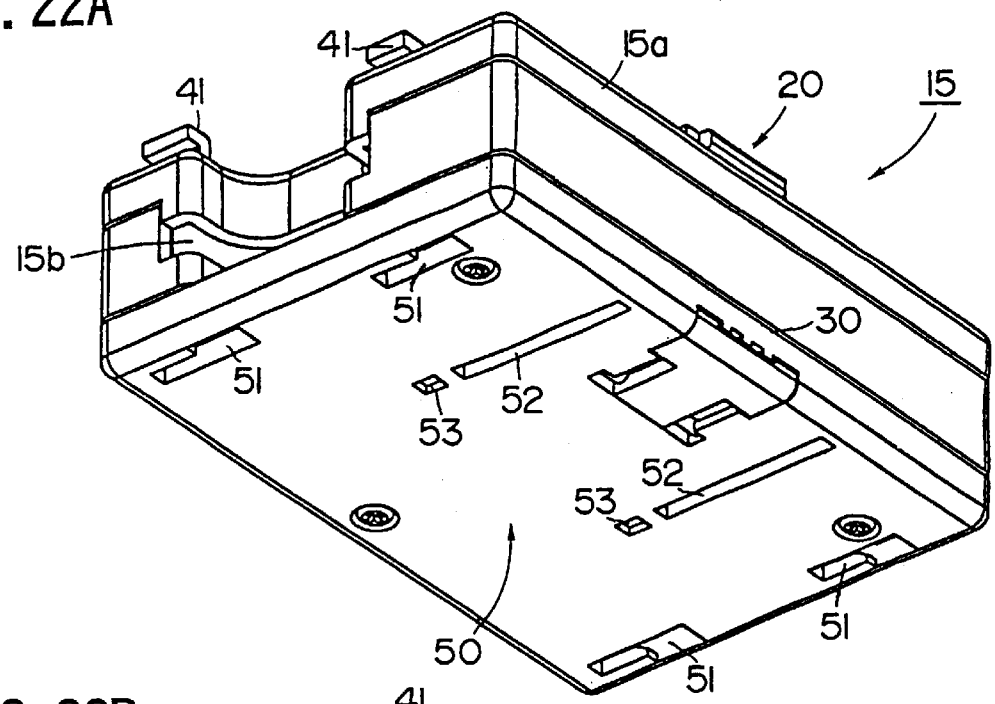
FIGS. 22A and 22B are perspective views of the USB-type connecting device of FIGS. 21A and 21B.
Figure 22B:
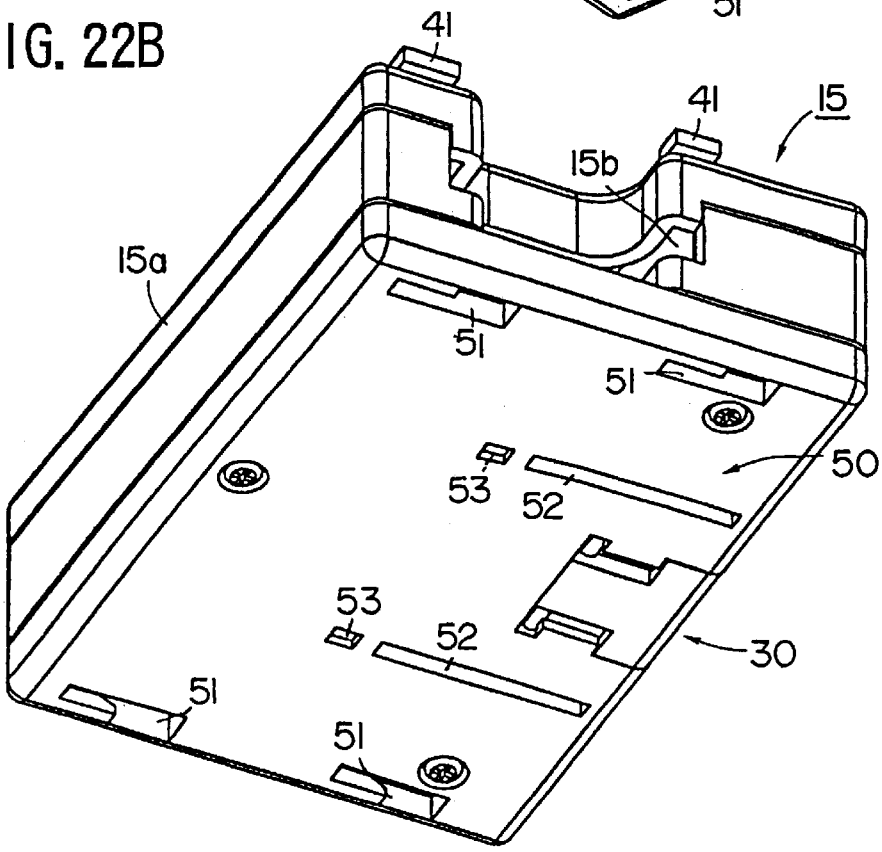
Figure 23A:
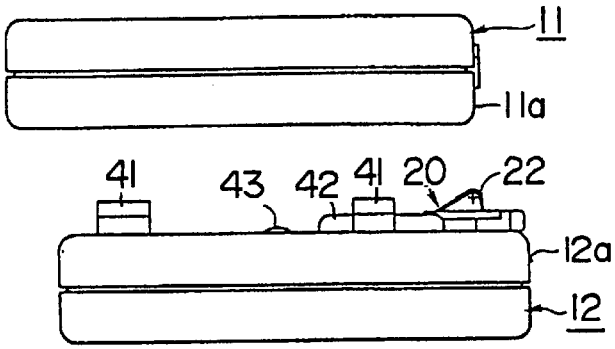
FIG. 23A is a right side view of the USB-type connecting device of FIG. 5A and the USB-type connecting device of FIG. 16A to be brought into contact with each other.
Figure 23B:
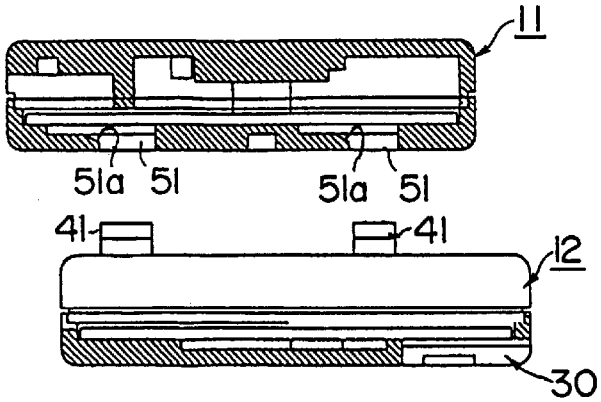
FIG. 23B is a sectional view of the USB-type connecting devices of FIG. 23A taken along hook holes.
Figure 23C:
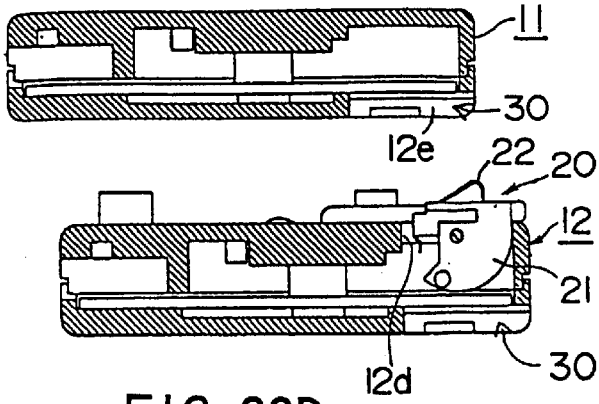
FIG. 23C is a sectional view of the USB-type connecting devices of FIG. 23A taken along the terminal unit.
Figure 23D:
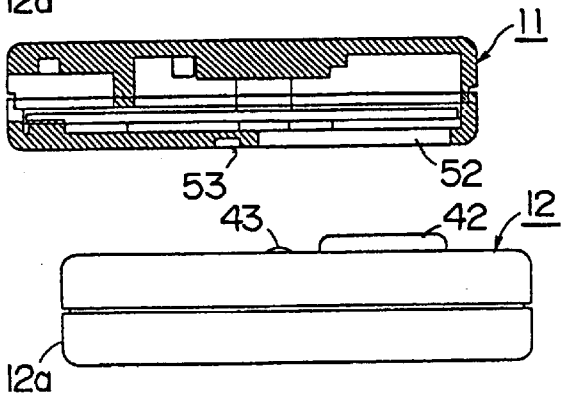
FIG. 23D is a sectional view of the USB-type connecting devices of FIG. 23A taken along guide grooves.

FIGS. 20A and 20B illustrate the USB-type connecting device 14. This USB-type connecting device 14 serves as a power source device for power supply for USB interfaces, and comprises a flat rectangular parallelepiped casing 14*a*, a contact point unit 20, a joining portion 40, and a power battery and a power circuit (not shown) disposed inside the casing 14*a*.

The contact point unit 20 and the joining portion 40 of the USB-type connecting device 14 are the same as the contact point unit 20 and the joining portion 40 of the USB-type connecting device 12.

FIGS. 21A, 21B, 22A, and 22B illustrate a modification of the USB-type connecting device 13 shown in FIGS. 18A, 18B, 19A, and 19B.

As shown in FIGS. 21A, 21B, 22A, and 22B, a USB-type connecting device 15 is a memory stick reader as an auxiliary memory unit, and comprises a flat rectangular parallelepiped casing 15*a*, a contact point unit 20 disposed on the upper surface of the casing 15*a*, a joining portion 40, a terminal unit 30 disposed on the lower surface of the casing 15*a*, and a joining portion 50 also provided on the lower surface of the casing 15*a*.

The contact point unit 20 serves as the USB port for the upper layers, and is connected to a chip-type USB hub circuit mounted on a substrate (not shown) disposed inside the casing 15*a*.

On the right side surface of the casing 15*a*, an insertion slot 15*b* for a memory stick is formed. Deep inside the insertion slot 15*b*, a connector to be connected to a connector unit of a memory stick and a control circuit (not shown) are mounted on the substrate.

The control circuit and the terminal unit 30 serve as the USB port for the lower layers, and are connected to the USB hub circuit.

The contact point unit 20, the terminal unit 30, and the joining units 40 and 50 of this modification have the same structures as the contact point unit 20, the terminal unit 30, and the joining units 40 and 50 of the USB-type connecting device 12.

The USB-type connecting system 10 provided with the contact point unit 20 of the present invention is structured as described so far. When the USB-type connecting system 10 is actually used, the USB-type connecting devices 11, 12, 13, and 14 are laminated on one another, and the laminated state is maintained as shown in FIG. 3.

In the following, a case where the USB-type connecting devices 11 and 12 are combined will be described.

As shown in FIGS. 23A to 23D, the upper USB-type connecting device 11 is positioned at a slightly forward location with respect to the lower USB-type connecting device 12. Here, the wider portion of each hook hole 51 formed on the lower surface of the casing 11*a* of the upper USB-type connecting device 11 faces each corresponding hook 41 formed on the upper surface of the casing 12*a* of the lower USB-type connecting device 12.

Figure 24A:
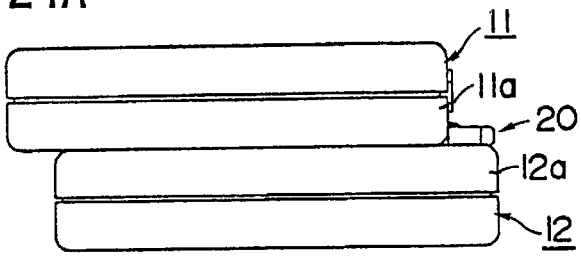
FIG. 24A is a right side view of the USB-type connecting device of FIG. 5A and the USB-type connecting device of FIG. 16A in contact with each other.

As shown in FIG. 24A, the upper USB-type connecting device 11 is then moved downward, so that the lower surface of the casing 11*a* of the USB-type connecting device 11 is brought into contact with the upper surface of the casing 12*a* of the USB-type connecting device 12.

Figure 24B:
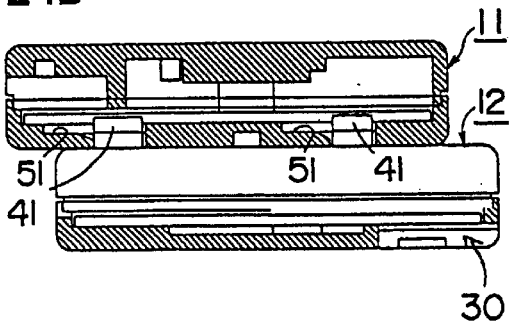
FIG. 24B is a sectional view of the USB-type connecting devices of FIG. 24A taken along the hook holes.
Figure 24C:
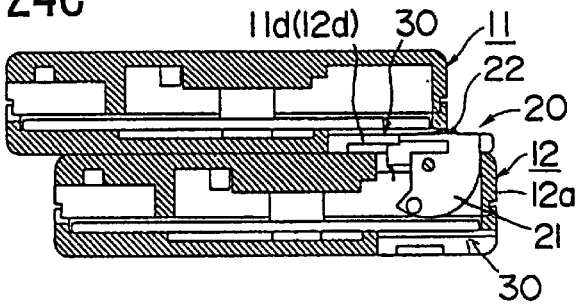
FIG. 24C is a sectional view of the USB-type connecting devices of FIG. 24A taken along the terminal unit.
Figure 24D:
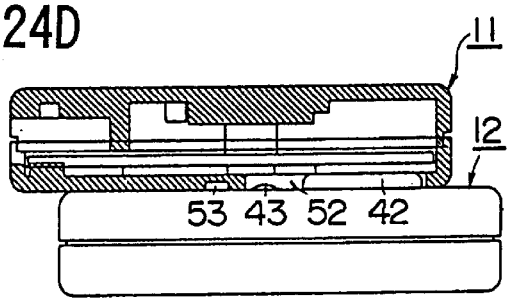
FIG. 24D is a sectional view of the USB-type connecting devices of FIG. 24A taken along the guide grooves.
Figure 25A:
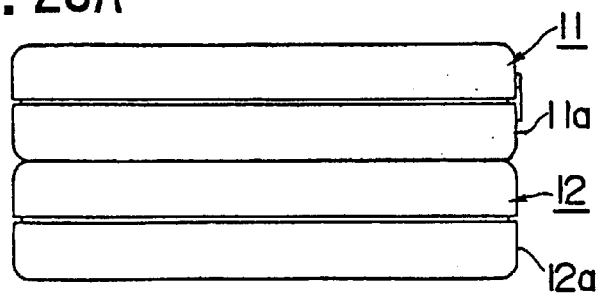
FIG. 25A is a right side view of the USB-type connecting device of FIG. 5A and the USB-type connecting device of FIG. 16A combined together.
Figure 25B:
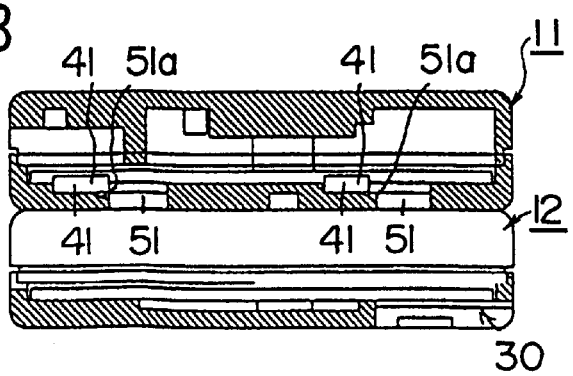
FIG. 25B is a sectional view of the USB-type connecting devices of FIG. 25A taken along the hook holes.
Figure 25C:
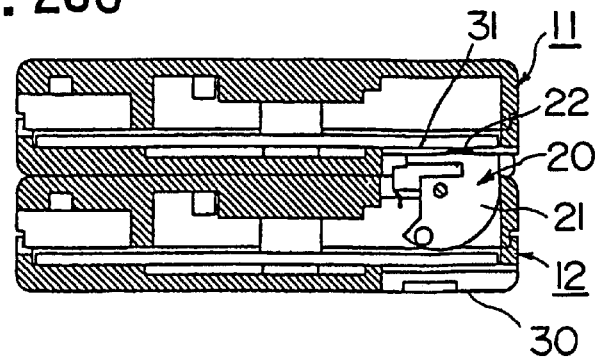
FIG. 25C is a sectional view of the USB-type connecting devices of FIG. 25A taken along the terminal unit.

The hooks 41 of the USB-type connecting device 12 are then inserted into the wider portions of the hook holes 51 of the USB-type connecting device 11, as shown in FIG. 24B. At the same time, the guide protrusions 42 of the USB-type connecting device 12 are inserted into the guide grooves 52 of the USB-type connecting device 11, as shown in FIG. 24C. Furthermore, the main body 21 and the contact points 22 of the contact point unit 20 protruding from the upper surface of the casing 12*a* of the USB-type connecting device 12 enter the casing 11*a* of the USB-type connecting device 11 through the window 11*d* formed on the lower surface of the casing 11*a*, as shown in FIG. 25C. Here, the contact points 22 are in contact with the respective terminals 31, and are pressed downward. As a result, the contact points 22 are elastically deformed, as shown in FIG. 9D.

The USB-type connecting device 11 is then moved backward with respect to the USB-type connecting device 12, so that the casing 11*a* and the casing 12*a* are aligned.

As the guide protrusions 52 are engaged with the guide grooves 42, the casing 11*a* of the USB-type connecting device 11 can be prevented from being deviated in the transverse direction. The hooks 41 of the USB-type connecting device 12 move in the hook holes 51 of the USB-type connecting device 11, so that the hook claws 41*a* of the hooks 41 slide along the sloped notches 51*a* of the hook holes 51, and are smoothly engaged with the narrow portions of the hook holes 51. Thus, the casing 11*a* and the casing 12*a* are secured to each other.

Figure 25D:
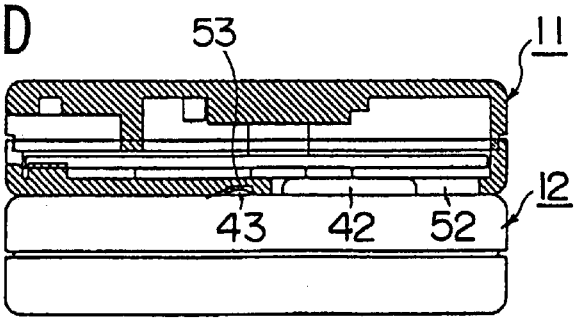
FIG. 25D is a sectional view of the USB-type connecting devices of FIG. 25A taken along the guide grooves.

Further, the positioning protrusions 43 of the USB-type connecting device 12 enter the positioning holes 53 of the USB-type connecting device 11, so that the casing 11*a* and the casing 12a are semi-locked to each other, and are engaged with each other in the backward and forward directions, as shown in FIG. 25D.

The ribs 21*a* on both sides of the main body 21 are engaged with the ribs 34 protruding inward from the window of the terminal unit 30 of the USB-type connecting device 11. As a result, the contact point unit 20 of the USB-type connecting device 12 is positioned to the terminal unit 30 of the USB-type connecting device 11 in the transverse direction (see FIGS. 7A, 7B, 8A, 8B, 14A, and 14B).

In the above manner, the assembling of the USB-type connecting device 11 and the USB-type connecting device 12 is completed.

The USB-type connecting devices 12, 13, and 14 are assembled in the same manner, thereby forming the USB connecting system 10 comprising the USB-type connecting devices 11, 12, 13, and 14, as shown in FIG. 3.

In the USB-type connecting system 10 having the above structure, personal computers can be connected to the USB ports lid and 11*e* of the upper layers of the USB-type connecting device 11 as the main USB hub via a USB cable. Also, a USB hub and various peripheral equipments, such as keyboard, mouse, printer, and scanner, can be connected to the USB ports 11*b*, 11*c*, 12*b*, and 12*c* of the lower layers of the USB-type connecting devices 11 and 12. Accordingly, those various peripheral equipments can be used from the personal computers via USB interfaces.

In this USB-type connecting system 10, no USB cables are used between the USB-type connecting devices 11, 12, 13, and 14, which are electrically connected to one another by means of the contact point units 20 and the terminals units 30. Since no USB cables and no space for connection using USB cables are required, the structure is simplified, and the space for connection can be minimized.

The USB ports lid and 11*e* of the USB-type connecting device 11 can be switched by the switch 11*f*. In other words, the two personal computers connected to the USB ports 11*d* and 11*e* are switched by the switch 11*f*, so that the various peripheral equipments connected by the USB-connecting system 10 can be selectively used through both two personal computers.

When more peripheral equipments are used by the USB-connecting system 10, the power supply from the personal computers might become insufficient. In such a case, the power battery contained in the USB-type connecting device 14 supplies sufficient power to the peripheral equipments connected to the USB-connecting system 10.

In the USB-type connecting system 10 shown in FIG. 3, it is possible to replace the USB-type connecting device 13 with the USB-type connecting device 15 that serves as a memory stick reader shown in FIGS. 20A, 20B, 21A, and 21B. It is also possible to interpose the USB-type connecting device 15 between the USB-type connecting devices 13 and 14, or the USB-type connecting devices 12 and 13.

With the USB-type connecting devices 11 to 15 of the present invention, the USB-connecting system 10 can be made up of a suitable combination of the USB-type connecting devices 11 to 15. The USB-connecting system 10 can be USB-connected to personal computers via the USB-connecting device 11, so that the peripheral equipments can be used through the personal computers. Also, since the USB-connection among the USB-connecting devices 11 to 15 does not require USB cables, there is no need for the space for USB cables, and the wiring arrangement can be simplified.

When the contact point unit 20 is not used, the main body 21 is rotatively moved around the rotational axis 23, so that the contact point unit 20 is carried to the contact point accommodating position. Accordingly, the contact point unit 20 is not exposed, and is well protected.

Meanwhile, the frame 32 formed from a part of the casing is provided between the terminals 31, so that no one will inadvertently touch the terminals 31. Also, the cover 33 completely covers the window so as to protect the terminals 31.

In the above described embodiments, the peripheral equipments to be connected to the USB ports 11*b*, 11*c*, 12*c*, and 12*b* include keyboard, mouse, printer, and scanner. However, it should be apparent that USB-type terminal adapter, CD-R (recordable compact disk) drives, or music instruments can be connected to those USB ports.

In the above embodiments, two types of USB ports 11*b*, 11*c*, 12*b*, 12*c* are provided to the USB-type connecting deices 11 and 12, but only one of the two types will be sufficient.

No USB ports are provided for the USB-type connecting devices 13, 14, and 15, but one or more USB ports may be provided to each USB-type connecting device.

It should be understood that the present invention can be applied to electronic devices having different structures from the USB-type connecting system 10 described in this specification.

The present invention is not limited to the specifically disclosed embodiments and variations, and modifications may be made without departing from the scope of the present invention.

What is claimed is:

1. An electronic device comprising:

a casing; and a contact point unit that includes a main body rotatively supported by a rotational axis extending between side surfaces of the casing, and one or more contact points attached to a surface of the main body;

wherein the main body is rotatively moved between a position where the one or more contact points are exposed and a position where the one or more contact points are accommodated in the casing, and when the contact point unit is not used, the main body of the contact point unit is rotatively moved so that the one or more contact points are accommodated in the casing, wherein the main body of the contact point unit is provided with a rotation stopper that is brought into contact with an upper surface of the casing when the main body is rotatively moved to the position where the one or more contact points are accommodated in the casing.

2. The electronic device as claimed in claim 1, wherein the one or more contact points are collectively molded with the main body of the contact point unit, and are bent in a U-shape; and when the one or more contact points are pressed by a terminal of a mating connector, a contact portion of the one or more contact points is elastically deformed.

3. The electronic device as claimed in claim 1, wherein the rotational axis extends through the geometric center of each side surface of the main body.

4. The electronic device as claimed in claim 1, wherein the main body has a cylindrical shape, with the rotational axis extending through the geometric, longitudinal center, except for a region of the one or more contact points.

* * * * *